US005813894A

United States Patent [19]

Tohyama

[11] Patent Number: 5,813,894

[45] Date of Patent: Sep. 29, 1998

[54] RUNNABLE BLOCK AND BLOCK TOY USING THE SAME

[75] Inventor: Tomoru Tohyama, Machida, Japan

[73] Assignee: Asahi Corporation, Tokyo, Japan

[21] Appl. No.: 637,040

[22] Filed: Apr. 24, 1996

[30] Foreign Application Priority Data

Apr. 28, 1995 [JP] Japan ..... 7-129344

[51] Int. Cl.[6] ..... A63H 33/04; A63H 17/26

[52] U.S. Cl. ..... 446/95; 446/448

[58] Field of Search ..... 446/90–91, 431, 446/462, 465, 470, 471, 448, 449, 456

[56] References Cited

U.S. PATENT DOCUMENTS

| | | | |
|---|---|---|---|
| 2,357,179 | 8/1944 | Ebeling | 446/449 |
| 2,577,102 | 12/1951 | Bolger | 446/449 |
| 2,791,867 | 5/1957 | Dasher | 446/92 X |
| 3,263,363 | 8/1966 | Doe | 446/465 |
| 3,996,692 | 12/1976 | Daenen | 446/95 X |
| 4,582,447 | 4/1986 | Itoh | 446/128 X |
| 4,710,148 | 12/1987 | Nagaoka | 446/95 X |
| 4,940,442 | 7/1990 | Matsuda | 446/95 X |
| 4,969,851 | 11/1990 | Rasmussen | 446/470 X |

FOREIGN PATENT DOCUMENTS

| | | | |
|---|---|---|---|
| 2156698 | 10/1985 | United Kingdom | 446/94 |
| 2182858 | 5/1987 | United Kingdom | 446/465 |
| 82/04195 | 12/1982 | WIPO | 446/93 |

*Primary Examiner*—Robert A. Hafer
*Attorney, Agent, or Firm*—Rabin, Champagne, & Lynt, P.C.

[57] ABSTRACT

A runnable block including a block body having a first engage projection and first engage recess respectively provided on the top and bottom surfaces of the block body, and four wheels rotatably attached to both sides of the block body via wheel shafts. A part of each wheel of this block protrudes farther downward than a lowermost surface including the lower engage section, and the diameter of each wheel is set approximately equal to the distance from the top of the first engage projection to the bottom of the first engage recess. As one block is coupled to another block by engaging the first engage projection of the former block to the first engage recess of the latter block, the wheels of both blocks mutually contact each other. This contact allows the rotation of one wheel to be transmitted to the other wheel, so that when the coupled blocks run, all the wheels of the blocks rotate.

26 Claims, 22 Drawing Sheets

RUNNABLE BLOCK AND BLOCK TOY USING THE SAME

BACKGROUND OF THE INVENTION

1. Field of the Invention

The present invention relates to a runnable block and a block toy which uses the runnable block.

2. Description of the Related Art

Conventionally, there are block toys with which children play and can create block assemblies with various shapes by combining blocks of synthesized resin. Such a block toy includes a plurality of rectangular parallel piped blocks each of which comprises a projecting engage section and a recessed engage section. A user engages the projecting engage sections and recessed engage sections of a plurality of blocks with one another to combine the blocks to thereby provide assemblies with various shapes. Such a block toy including only blocks with rectangular cylindrical shapes cannot ensure a variety of variations. As a solution to this shortcoming, prism-shaped blocks and blocks with wheels are supplemented.

While this block toy can form assemblies with a variety of shapes, it suffers poor motions of the created assemblies and poor deviceability.

SUMMARY OF THE INVENTION

Accordingly, it is a primary object of the present invention to provide runnable blocks which allow a user to create assemblies with multifarious shapes and with a variety of motions, and which have an excellent deviceability.

According to the first aspect of this invention, there is provided a block toy having at least two runnable blocks, wherein each of the runnable block comprises a block body having engage sections respectively provided on top and bottom surfaces of the block body and engageable with engage sections of another block body; and a plurality of wheels rotatably attached on both sides of the block body, whereby a part of each of the wheels protrudes farther downward than a lowermost surface including the lower engage section, and with other block bodies coupled to a top and bottom of one block body, a diameter of each wheel is set approximately equal to a distance from an attaching surface of the upper engage section to the lower engage section of the other runnable block located above the one block body to an attaching surface of the lower engage section to the upper engage section of the other runnable block located below the one block body. In other words, at the time blocks are placed one another, therefore, the outer surfaces of the wheels of the upper block contact those of the associated wheels of the lower block.

According to the second aspect of this invention, there is provided a runnable block which comprises a block body having engage sections respectively provided on top and bottom surfaces of the block body and engageable with engage sections of another block body; and a plurality of wheels rotatably attached to both sides of the block body, whereby a part of each of the wheels protrudes farther downward than a lowermost surface including the lower engage section and a diameter of each wheel is set approximately equal to a distance from an attaching surface of the upper engage section to the lower engage section of another runnable block to an attaching surface of the lower engage section to the upper engage section of another runnable block.

In this case, it is desirable that a block coupling portion should be provided on the front and rear faces of the block body. It is also desirable that a wheel engage portion be provided on the wheel surface of each wheel. It is desirable that the upper and lower engage sections be provided on substantially the center portions of the top and bottom surfaces of the block body, respectively. Further, it is desirable that the upper one of the engage sections should be formed in the shape of a projection or a recess or the shape of the combination of the projection and recess, and the lower engage section should be formed in the shape of a recess or a projection or the shape of the combination of the recess and projection, which is mateable with the projection or recess or the combination of the projection and recess. Furthermore, the engage sections may have upper and lower first engage sections provided approximately at the center of the top and bottom surfaces of the block body, lower second engage sections, provided on the front side and/or the rear side of the bottom of the block body with respect to the center of the bottom, and upper second engage sections provided on the top of the block body. The lower second engage sections may be engageable with the upper first engage sections and/or the upper second engage sections of another runnable block, and the upper second engage sections may be engageable with the lower first engage sections and/or the lower second engage sections of another runnable block. It is desirable that the engage sections, the block coupling portions and the wheel engage portions should be any one of an engage member, a fitting member, a magnet, a planar zipper, an adhesive and a sucker. It is also desirable that at least one block should be provided with a driving device for driving the wheels.

According to this invention, the engage sections for permitting blocks to be coupled together are provided on the top and bottom surfaces of the block body. As the upper engage section of one block is coupled to the lower engage section of another block, therefore, those blocks can be coupled to one on another. As wheels are attached to the block body, a user can play running each block alone. Further, the diameter of each wheel is set approximately equal to the distance from the top of the first engage projection to the distance to the bottom of the first engage recess. At the time blocks are placed one on another, therefore, the outer surfaces of the wheels of the upper block contact those of the associated wheels of the lower block. As the wheels of one of the upper and lower blocks rotate, therefore, the wheels of the other block also rotate. As the user moves the joined blocks, the upper wheels as well as the lower wheels rotate simultaneously. The assembly of two or more blocks can have a variety of motions and can have an excellent deviceability. If the colors and patterns of blocks are designed like those of real automobiles such as sports cars, the individual blocks would show the sense of existence and could thus be used as a toy themselves.

In this case, if block coupling portions are provided at the front and rear faces of each block body, one block can be coupled to the front of another block as well as the back thereof. If a wheel attaching section which allows wheels to be coupled together is provided on the wheel surface of each wheel, blocks can be coupled to sideways (to the right or the left). If the upper and lower engage sections are provided at approximately the center of both upper and lower surfaces of each block body, two blocks can be connected one on the top of the other in a vertically aligned manner. As the lower second engage sections are engageable with the upper first engage sections and/or the upper second engage sections of another runnable block, and the upper second engage sections are engageable with the lower first engage sections and/or the lower second engage sections of another runnable block, an upper block can be placed on a lower block, shifted frontward or rearward, at the time both blocks are coupled to one on the top of the other. It is therefore possible to mount different blocks at the front and rear sides of one block. This provides a greater variation of the assemblies of blocks, thus allowing assemblies of multifarious shapes to be created. If at least one block is equipped with a driving device, the rotation of the wheels driven by the driving device is transferred to the lowermost wheels, regardless of the position of the block which is equipped with the driving device when a plurality of blocks are coupled to one on another.

DETAILED DESCRIPTION OF THE PREFERRED EMBODIMENTS

First Embodiment

Figure 1:
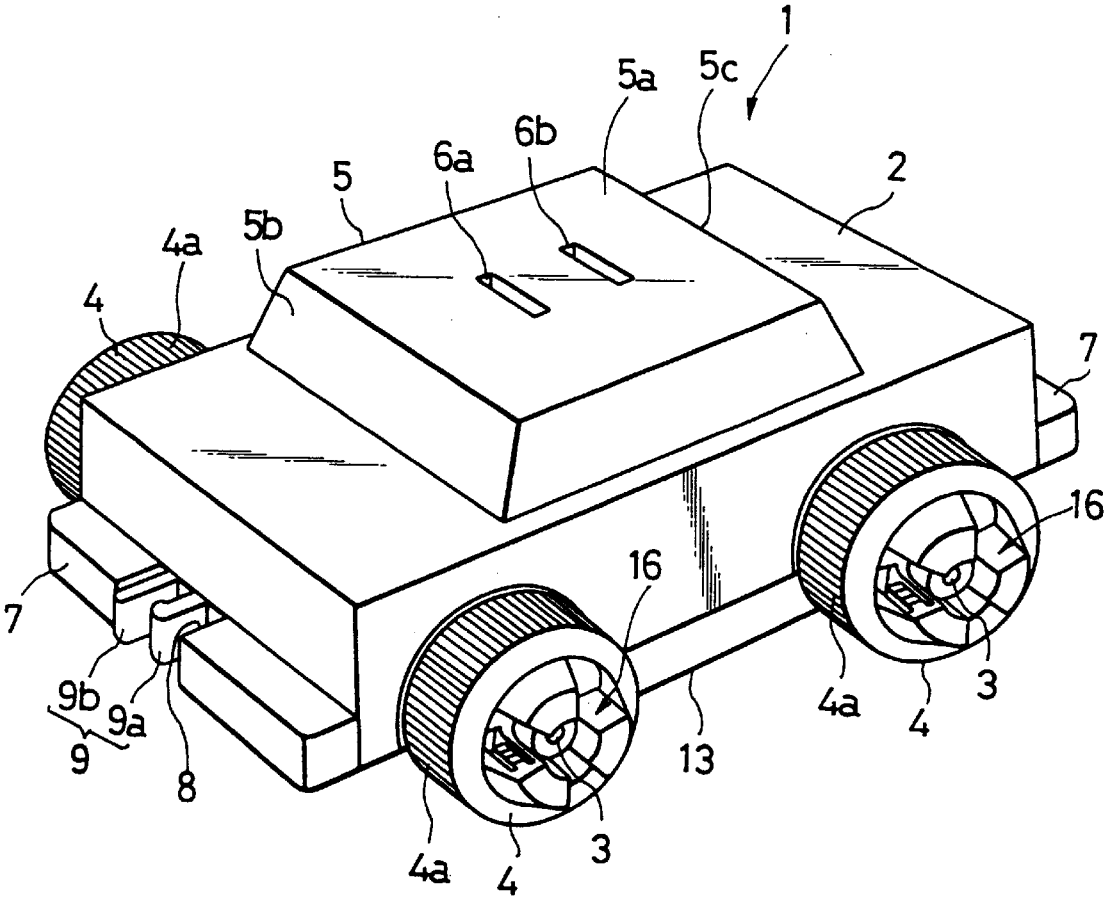
FIG. 1 is a perspective view of a block according to the first embodiment of this invention as viewed from obliquely above.

A block toy using runnable blocks according to the first embodiment of the present invention will now be described referring to FIGS. 1 through 13.

FIGS. 1 through 5 illustrate a runnable block 1 according to the first embodiment of this invention. The block 1 comprises a block body 2, and four wheels 4 which are attached to both sides of the block body 2 via wheel shafts 3.

The block body 2 is made of synthesized resin, and is shaped like a vehicle. A first engage projection 5 shaped like the roof of a vehicle is formed at the center of the top of the block body 2. The first engage projection 5 corresponding to the roof of the vehicle or the block body 2 is so tapered that the individual sides form a truncated pyramid, making the top side narrower than the bottom side. Provided at the center of the top surface of the first engage projection 5 are two second engage holes 6*a* and 6*b* for changing the attaching position of the block 1 when this block 1 is coupled to another block 1.

Figure 4:
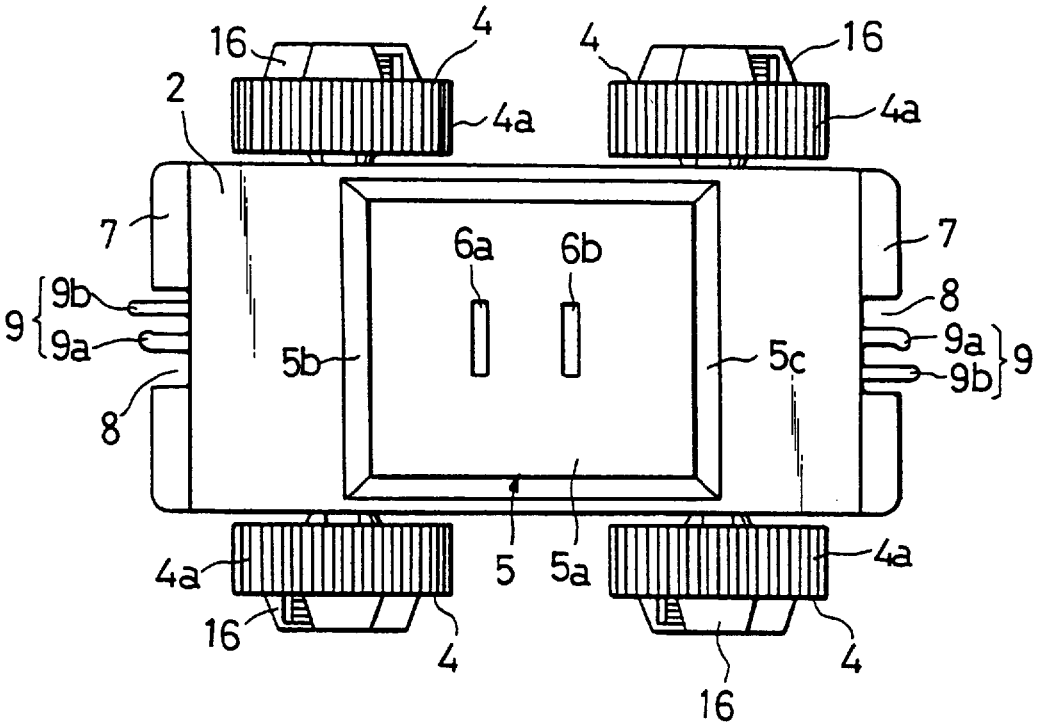
FIG. 4 is a plan view of the block according to the first embodiment of this invention.
Figure 5:
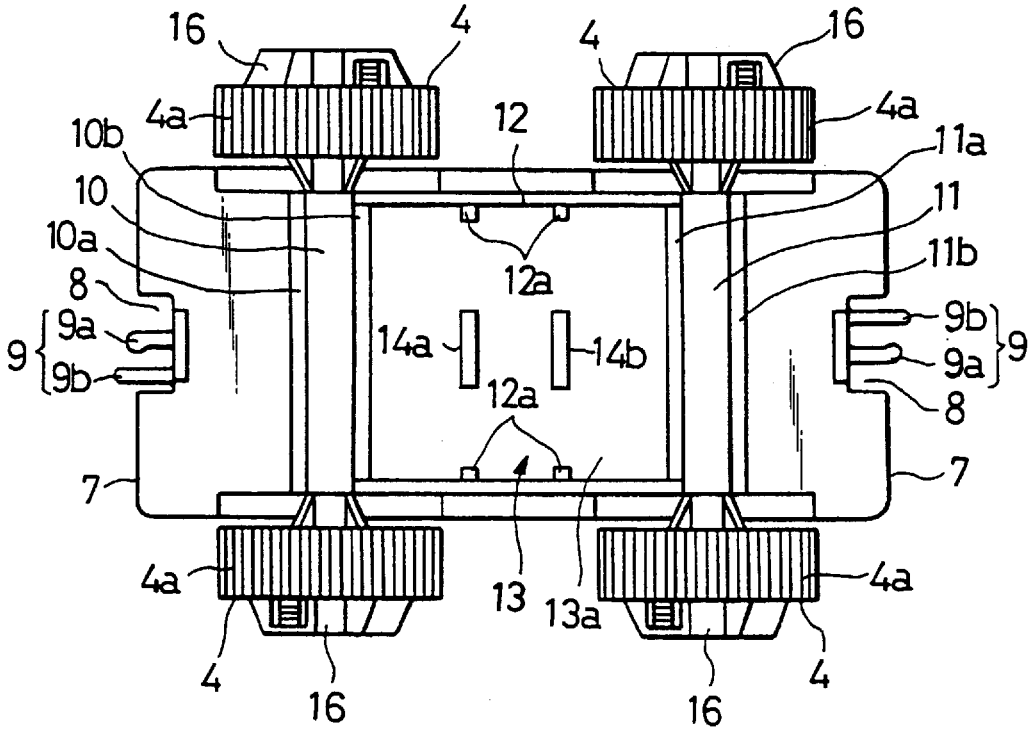
FIG. 5 is a bottom view of the block according to the first embodiment of this invention.

Bumper sections 7 are respectively provided at the front and rear faces of the block body 2 with a recess 8 provided at the intermediate portion of each bumper section 7. A block coupling portion 9 is provided in each recess 8. Each block coupling portion 9 has two projection pieces 9*a* and 9*b* which slightly protrude from the tip of the associated bumper section 7, as shown in FIGS. 4 and 5. The tip of the projection piece 9*a* stretches at least toward the projection piece 9*b* in a circular shape.

Figure 2:
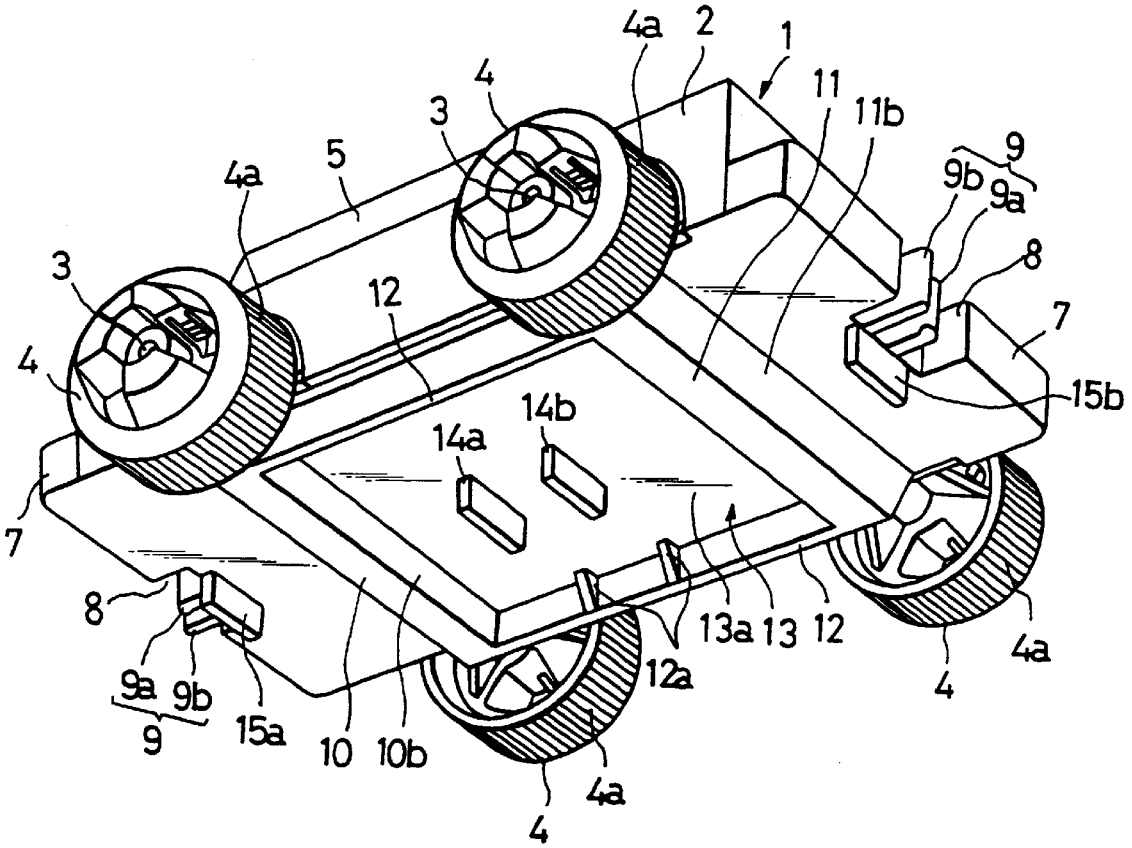
FIG. 2 is a perspective view of the block according to the first embodiment of this invention as viewed from obliquely below.

Wheel-shaft attaching sections 10 and 11 are provided at the bottom of the block body 2 across both widthwise (right and left) ends of the block body 2 as shown in FIG. 2. The wheel-shaft attaching sections 10 and 11 are so provided as to contact the front face 5*b* and rear face 5*c* of the first engage projection 5 of an underlying block 1. The front (left in FIGS. 2 and 5) wheel-shaft attaching section 10 of the block body 2 has a rear face 10*b* inclined at the same angle as the front face 5*b* of the first engage projection 5, and a front face 10*a* inclined at the same angle as the rear face 5*c* of the first engage projection 5. The rear (right in FIGS. 2 and 5) wheel-shaft attaching section 11 of the block body 2 has a front face 11*a* inclined at the same angle as the rear face 5*c* of the first engage projection 5, and a rear face 11*b* inclined at the same angle as the front face 5*b* of the first engage projection 5. Therefore, each wheel-shaft attaching section 10 or 11 is inverted trapezoidal in cross section.

Provided between the wheel-shaft attaching sections 10 and 11 at the left and right side walls 12 which have the same heights as the wheel-shaft attaching sections 10 and 11, as shown in FIG. 2. Provided on the inner surfaces of the side walls 12 are ribs 12*a* whose surfaces are inclined at the same angles as left and right side faces 5*d* and 5*e* of the first engage projection 5. The side walls 12 having those ribs 12*a* and the wheel-shaft attaching sections 10 and 11 constitute a first engage recess 13 which engages with the first engage projection 5 of another block 1.

Provided at the center of the first engage recess 13 are lower second engage protrusions 14*a* and 14*b* which are to respectively engage with the second engage holes 6*a* and 6*b* of another block 1, as shown in FIG. 2. Provided on the front end portion of the bottom of the block body 2 is a second engage protrusion 15*a* which is to engage with the second engage hole 6*b* of another block 1 when the front face 10*a* of the front wheel-shaft attaching section 10 comes in contact with the rear face 5*c* of the first engage projection 5 of that another block 1. Provided on the rear end portion of the bottom of the block body 2 is a second engage protrusion 15*b* which is to engage with the second engage hole 6*a* of another block 1 when the rear face 11*b* of the rear wheel-shaft attaching section 11 comes in contact with the front face 5*b* of the first engage projection 5 of that another block 1.

Figure 6A:
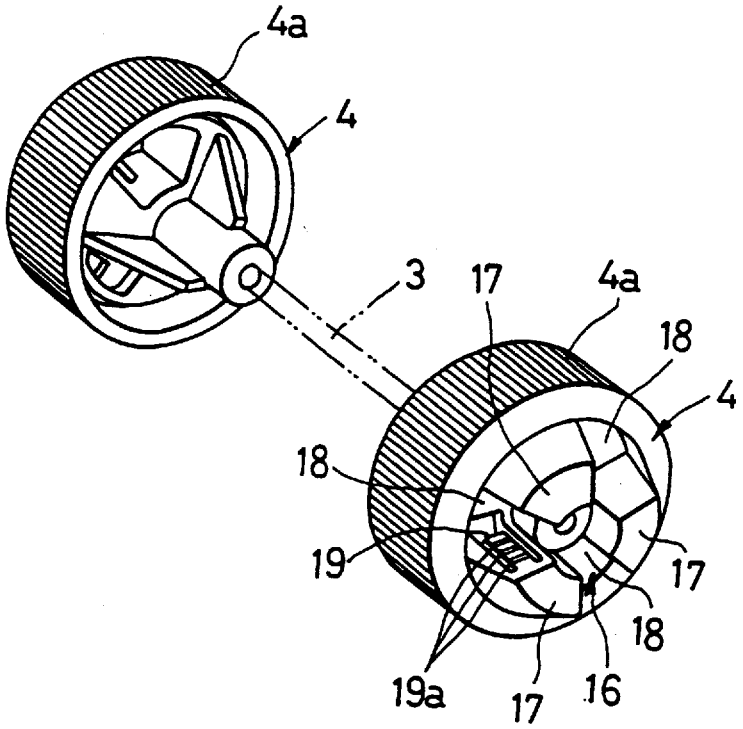
FIG. 6A is an enlarged perspective view of wheels of the block according to the first embodiment of this invention.

Wheel shafts 3 are provided on the respective wheel-shaft attaching sections 10 and 11, protruding from the right and left sides of the block body 2. Each wheel shaft 3 is made of a metal rod to whose tip the associated wheel 4 is rotatably attached. The outer surface of each wheel 4 is formed as a transmission surface 4*a*, which has multiple grooves embedded therein and transfers power and rotation to another wheel 4. A wheel coupling section 16, which allows the wheels 4 to be coupled together, is provided on the wheel surface of each wheel 4. As shown in FIG. 6A, each wheel coupling section 16 has three fan-shaped fitting projections 17 and three fan-shaped fitting recesses 18 alternately arranged in a ring shape. The distal end face of each fitting projection 17 protrudes from the wheel's outer surface, and the bottom of each fitting recess 18 is dented deeper than the wheel's outer surface.

The rising face of each fitting projection 17 is integral with and continuous to the falling face of the associated fitting recess 18 with the wheel's outer surface as the boundary. Each fitting projection 17 and each fitting recess 18 are shaped to match the sizes of the mating recess 18 and projection 17. At the time the wheels 4 are coupled together, therefore, if each fitting projection 17 of one wheel 4 is fitted into the associated fitting recess 18 of another wheel 4, each fitting projection 17 of the latter wheel 4 is simultaneously fitted into the associated fitting recess 18 of the former wheel 4, so that the wheels 4 are coupled together with the associated wheels' outer surfaces facing one another. A spring piece 19 is formed by cutting, on each continuous surface between each fitting projection 17 and each fitting recess 18. When the wheels 4 are coupled together, this spring piece 19 urges the wheels 4 in the direction where the coupled wheels 4 elastically contact with each other. The spring piece 19 has protruding portions 19*a* formed on its outer surface, so that when the wheels 4 are coupled together to elastically contact with each other, the protruding portions 19*a* of one wheel 4 face those of the other wheel 4 in a shifted state, and when the coupled wheels 4 are to be disengaged from each other, the protruding portions 19*a* of the wheels 4 catch each other by the spring force of the spring pieces 19.

Figure 3:
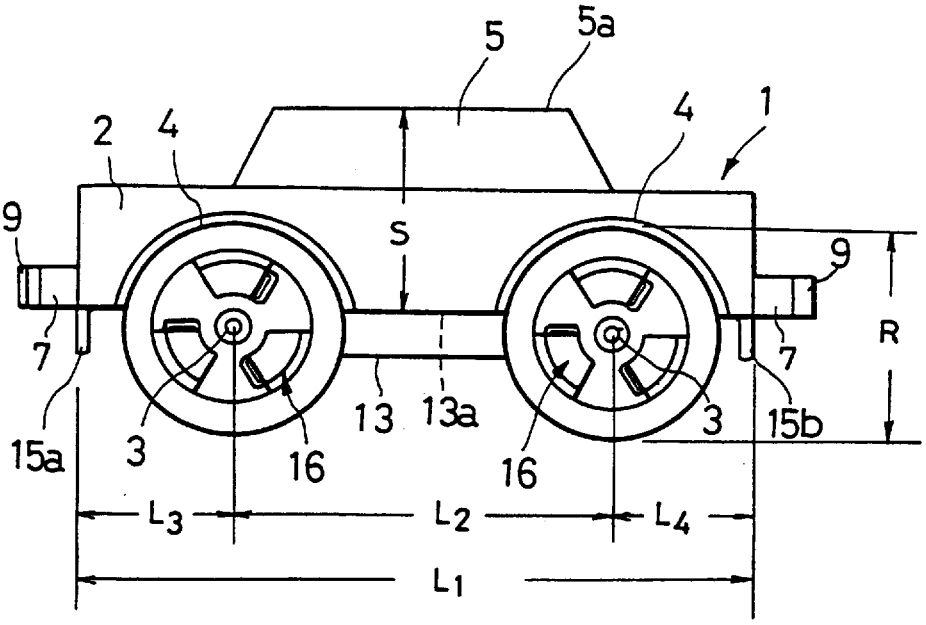
FIG. 3 is a side view of the block according to the first embodiment of this invention.

As shown in FIG. 3, a part of each wheel 4 protrudes below the bottom of the first engage recess 13, which is comprised of the wheel-shaft attaching sections 10 and 11 and the side walls 12, and the lower end faces of the individual engage protrusions 14*a*, 14*b*, 15*a* and 15*b*. The diameter R of each wheel 4 is set equal to a distance S from the top surface (attaching surface) 5*a* of the engage section 5 of the block body 2 to the bottom surface (attaching surface) 13*a* of the lower engage recess 13 of the block body 2, or is set slightly longer than the distance S. The length $L_1$ of the block body 2 in the forward and backward direction is approximately twice the distance $L_2$ between the wheel shafts ($L_1=L_2\times2$). The wheel shaft distance $L_2$ is set approximately equal to the sum of the distance $L_3$ from the front wheel shaft 3 to the front end of the block body 2 and the distance $L_4$ from the rear wheel shaft 3 to the rear end of the block body 2 ($L_2=L_3+L_4$). The distance $L_3$ from the front wheel shaft 3 to the front end of the block body 2 is set substantially equal to the distance $L_4$ from the rear wheel shaft 3 to the rear end of the block body 2 ($L_3\approx L_4$).

Figure 6B:
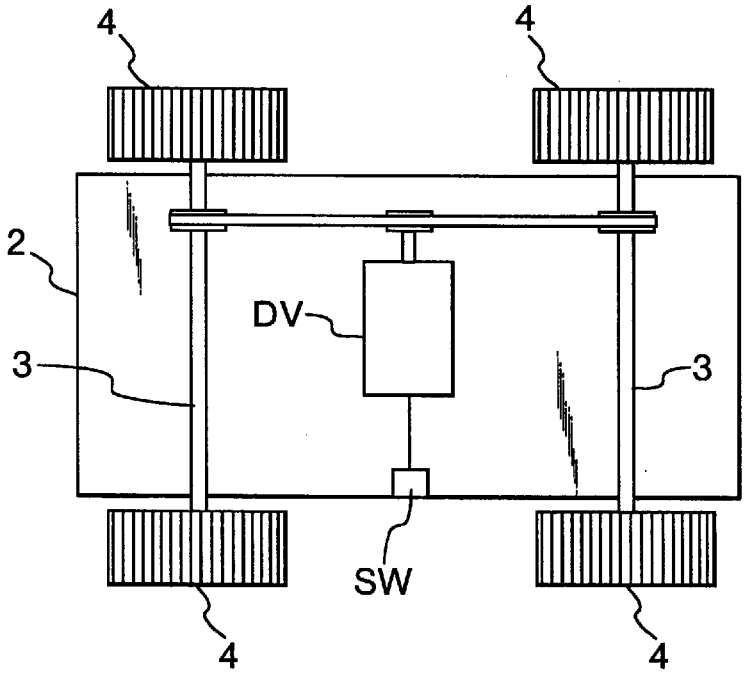
FIG. 6B is a diagram showing a driving device for driving the wheels.

The block body 2 of at least one of a plurality of blocks 1 which constitute a block toy incorporates a driving device (motor or the like) DV for driving the four wheels 4, as shown in FIG. 6B.

Figure 7:
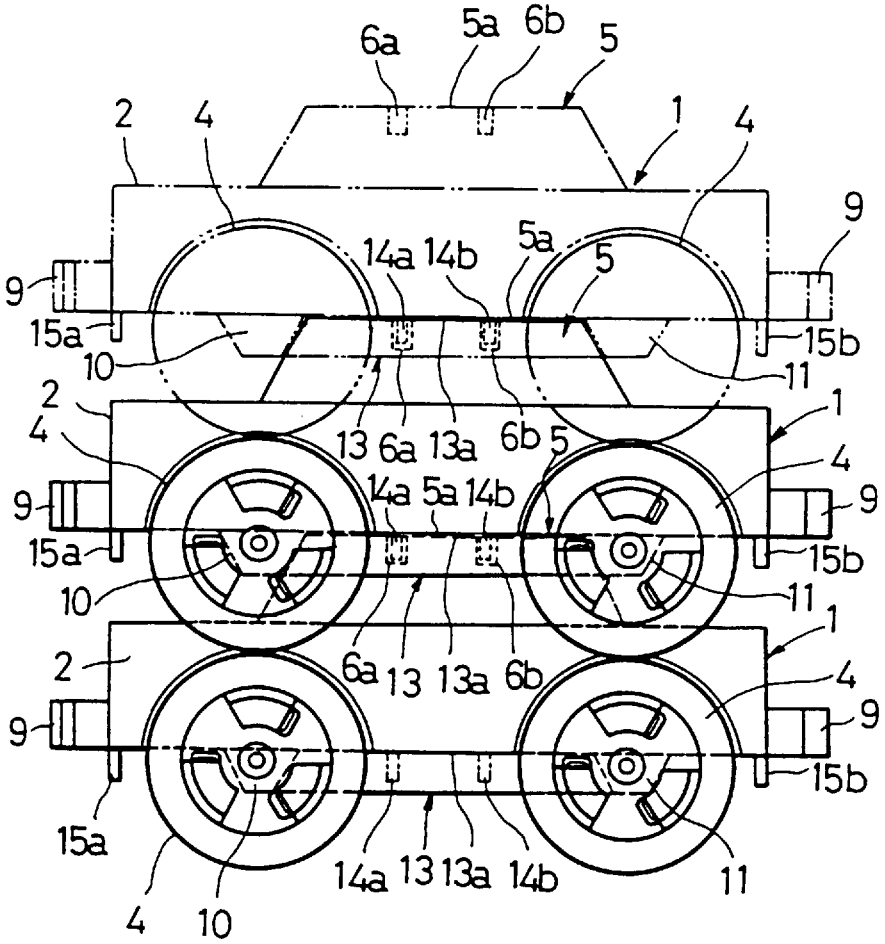
FIG. 7 is a side view showing blocks coupled to one on another according to the first embodiment of this invention.

As shown in FIG. 7, two blocks 1 can be coupled together by engaging the first engage projection 5 of one block 1 with the first engage recess 13 of the other block 1. At this time, the second engage protrusions 14*a* and 14*b* provided on the center of the first engage recess 13 respectively engage with the second engage holes 6*a* and 6*b* formed in the top of the first engage projection 5. The two blocks 1 can therefore be coupled together surely and firmly.

As mentioned above, the diameter R of each wheel 4 is set substantially equal to the distance S from the top surface 5*a* of the first engage section 5 to the bottom surface 13*a* of the first engage recess 13. When two blocks 1 are placed one on the other, therefore, the outer surfaces of the individual wheels 4 of the overlying block 1 respectively contact those of the underlying block 1. Because multiple grooves are embedded in the outer surface of each wheel 4 to serve as the transmission surface 4*a* to transfer power to another wheel 4, when the wheels 4 of either the overlying block 1 or those of the underlying one rotate, the rotation is transferred to the wheels 4 of the other block. Thus, the wheels 4 of the other block 1 also rotate. As a part of each wheel 4 is protruding below the first engage recess 13, the user can place the block 1 on a table or the like and run it thereon. In running vertically coupled blocks 1, the wheels 4 of the overlying block 1 rotate in accordance with the rotation of the wheels 4 of the underlying block 1. Therefore, the assembled blocks 1 could have a variety of motions and would be excellent in deviceability.

Because of the multiple grooves embedded in the outer surface of each wheel 4 to serve as the transmission surface 4*a*, when the block 1 runs on a table or the like, the wheels 4 roll without skidding on the table or the like. If one of two blocks 1 is equipped with the driving device DV, the two blocks 1, one overlying the other, can automatically run. Even if the block 1 equipped with the driving device DV is placed at the uppermost position at the time of three or more blocks 1 are put one another as indicated by the two-dot chain line in FIG. 7, the rotation of the wheels 4 of the uppermost block 1 driven by the driving device DV is transferred to the wheels 4 of the lowermost block 1 so that the assembled blocks 1 can automatically run on a table or the like. The assembled blocks 1 can run similarly regardless of where the block 1 equipped with the driving device DV is positioned.

Figure 8:
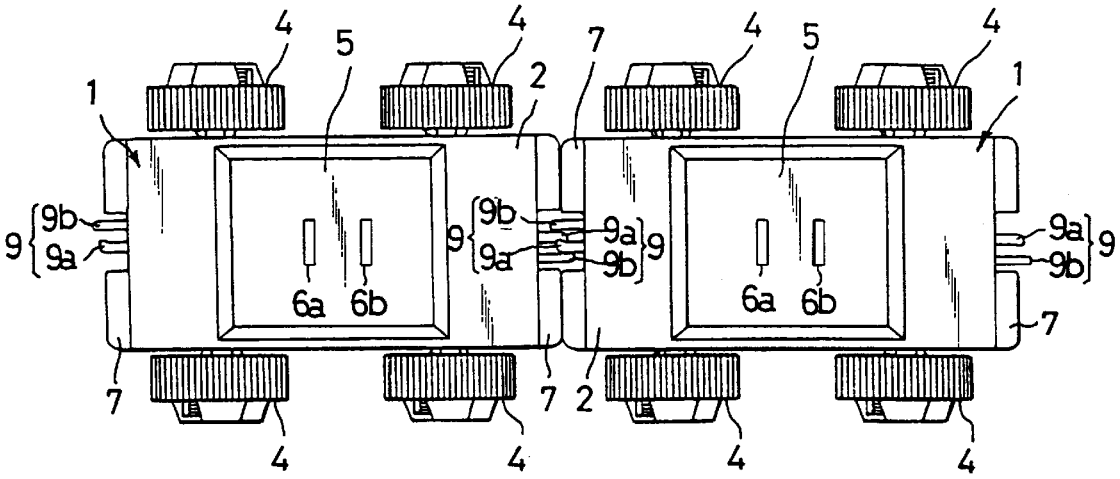
FIG. 8 is a plan view showing one block coupled to the front of the other according to the first embodiment of this invention.

As mentioned earlier, the block coupling portions 9 are provided at the front and rear faces of the block body 2. Therefore, blocks 1 can be coupled together in a line, one in front of or at the back of another, by connecting the block coupling portion 9 of one block 1 to the block coupling portion 9 of another block 1, as shown in FIG. 8. As the projection piece 9*a* with the circular distal end among the two projection pieces 9*a* and 9*b* of the block coupling portion 9 of one block 1 is inserted between the two projection pieces 9*a* and 9*b* of the block coupling portion 9 of another block 1, the projection pieces 9*a* catch each other to couple the blocks 1 together. To disconnect the blocks 1 from each other, their block coupling portions 9 should be pulled away from each other against the catching force of the projection pieces 9*a*. As the block coupling portion 9 is provided in the recess 8 of the bumper section 7, only the distal ends of the two projection pieces 9*a* and 9*b* protrude from the bumper section 7. If the block bodies 2 are hit against each other or are dropped, the projection pieces 9*a* and 9*b* are unlikely to be damaged.

Figure 9:
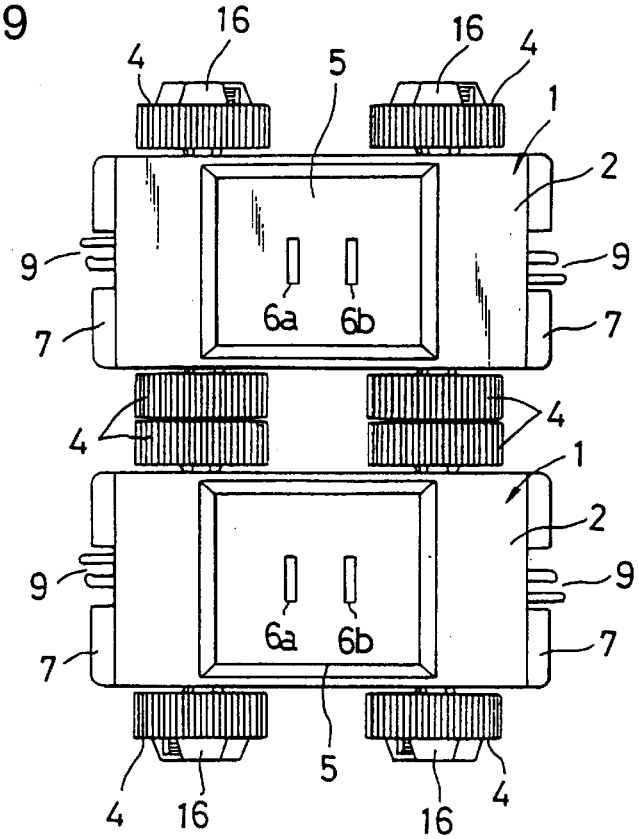
FIG. 9 is a plan view showing blocks coupled sideways to each other according to the first embodiment of this invention.

The wheel coupling section 16 is provided on the wheel surface of each wheel 4 as mentioned above. Blocks 1 are arranged side by side (up and down in FIG. 9) so that the wheels on one side of one block 1 face those of the other block 1, and the individual fitting projections 17 of the wheel coupling sections 16 of one block 1 are fitted in the associated fitting recesses 18 of the wheel coupling sections 16 of the other block 1. As a result, the wheels 4 of the two blocks 1 can be coupled together. For example, two blocks 1 may be arranged side by side so that two wheels 4 of one block 1 are coupled to two wheels 4 of the other block 1, as shown in FIG. 9. Two blocks 1 may be so arranged with one block 1 shifted frontward by about a half length so that only one wheel 4 of one block 1 is coupled to one wheel 4 of the other block 1. The number of blocks 1 to be coupled is not limited to two, but multiple blocks 1 may be coupled one by one in the same manner. Further, with one block 1 coupled to the front of another as shown in FIG. 8, two wheels 4 of the third block 1 may be coupled to one wheel 4 of the front block 1 and one wheel 4 of the back block 1. A plurality of blocks 1 coupled in this manner can run side by side in an integral form.

In coupling the wheels 4 in such a manner, as each fitting projection 17 of one wheel coupling section 16 is fitted in the associated fitting recess 18 of the other wheel coupling section 16, the remaining fitting projections 17 are respectively fitted in their mating fitting recesses 18. Accordingly, not only the rotation of the wheels 4 of one block 1 can be transferred to the wheels 4 of another block 1, but also the blocks 1 can be held together. When the user lifts one block 1, therefore, the other block 1 can be lifted also. With the wheels 4 coupled together, the protruding portions 19*a* catch each other by the spring force of the spring pieces 19, the wheels 4 can surely connected together. To disconnect the coupled wheels 4, the wheels 4 should be pulled away against this spring force of the spring pieces 19.

Because the second engage holes 6*a* and 6*b* are formed in the top surface of the first engage projection 5 and the second engage protrusions 15*a* and 15*b* are provided on the bottom surface of the block body 2, one block 1 can be coupled to another block 1 in such a manner that the former block 1 is shifted frontward or rearward with respect to the latter block 1.

Figure 10:
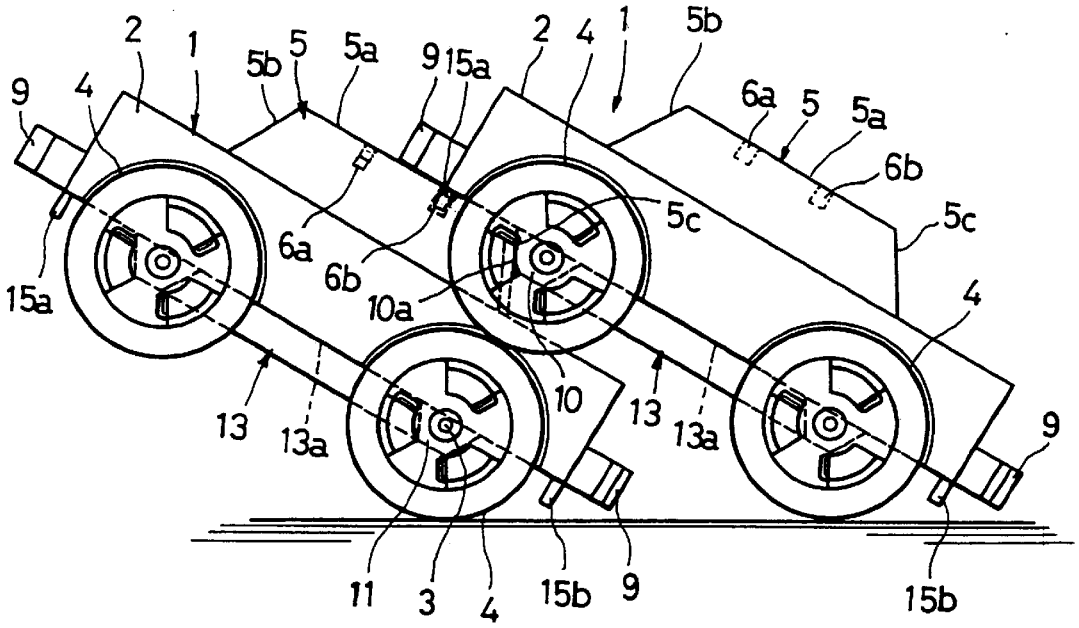
FIG. 10 is a side view showing one block coupled to another and shifted frontward, according to the first embodiment of this invention.

If one block 1 is coupled to another block 1 in a rearward shifted fashion (rightward in FIG. 10), for example, the front face 10*a* of the wheel-shaft attaching section 10 of the overlying block 1 should contact the rear face 5*c* of the first engage projection 5 of the underlying block 1 so that the second engage protrusion 15*a* located at the front end of the overlying block 1 is engaged with the second engage hole 6*b* of the underlying block 1. In this case, the blocks 1 are placed one on the other with the rear wheels 4 of the underlying block 1 being in contact with the front wheels 4 of the overlying block 1. As shown in FIG. 10, therefore, each block 1 can be tilted with the front side facing upward and the entire blocks 1 become stable while the rear wheels 4 of the underlying block 1 and the rear wheels 4 of the overlying block 1 are in contact with a table.

Even when the coupled blocks 1 become stable in a tilted fashion with the front side facing upward or downward, the coupled blocks 1 can run well on the table. The number of blocks 1 to be coupled is not limited to two, but an arbitrary number of blocks 1 can be placed one on another.

Figure 11:
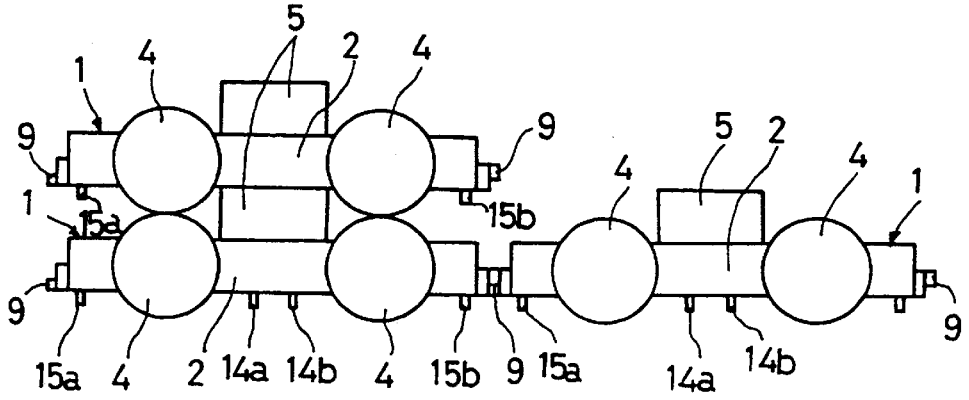
FIG. 11 is a side view showing two blocks coupled to one on the other with another block coupled to the back of the lower block according to the first embodiment of this invention.
Figure 12:
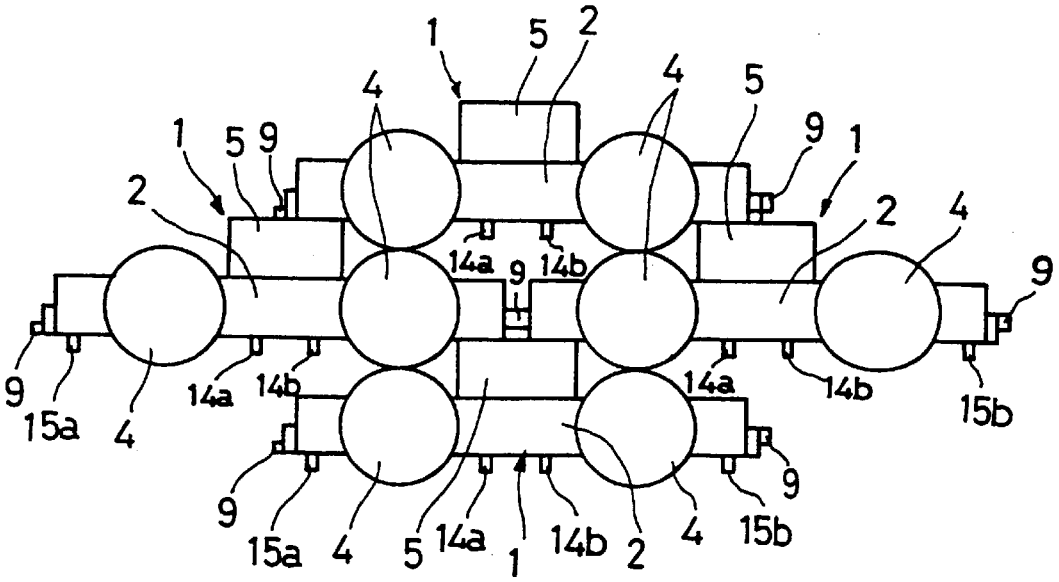
FIG. 12 is a side view showing the assembly of two blocks coupled to one on the other and shifted frontward and another similar assembly of two blocks being placed on the former assembly according to the first embodiment of this invention.
Figure 13:
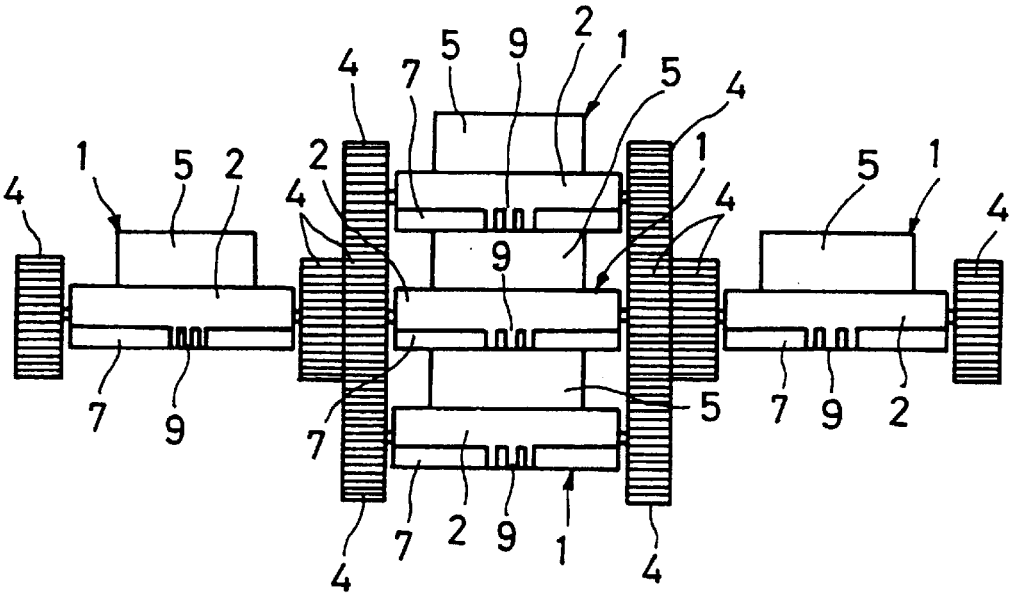
FIG. 13 is a side view showing three blocks coupled to one on another with two other blocks coupled to right and left sides of the intermediate block according to the first embodiment of this invention.

According to this block toy, the assemblies as shown in FIGS. 11 through 13 become available by combining the aforementioned various assemblies. In those diagrams, each block 1 is illustrated schematically.

FIG. 11 illustrates one assembly in which one block 1 is placed on another block 1 and the third block 1 is coupled at the block coupling portion 9 at its front to the block coupling portion 9 at the back of the underlying block 1. As a modification of this assembly, two or more blocks 1 may be placed on one block 1 and a plurality of blocks may be coupled one by one to the lowermost block 1. In this assembly, the entire block assembly can run if the block 1 equipped with the driving device is included as a key block in the assembly. Because all the wheels 4 rotate when the block assembly runs, the block assembly shows a very sophisticated motion and has an excellent deviceability. The same advantage can be acquired regardless of the location of the block 1 equipped with the driving device in the assembly.

It is however desirable that the block 1 with the driving device should be placed at the position (e.g., the topmost position, the rear most position, or the frontmost position) where it is easy for the user to operate a switch (SW) of the driving device.

FIG. 12 illustrates an assembly in which two blocks 1 are placed on one block 1, and the fourth block 1 is placed on those two overlying blocks 1. In this case, the second engage protrusion 15*a* at the front end of the topmost block 1 is engaged with the second engage hole 6*b* of the underlying front (left in FIG. 12) block 1. The lower second engage protrusion 15*a* at the rear end of the topmost block 1 is engaged with the second engage hole 6*a* of the underlying rear (right in FIG. 12) block 1. The topmost block 1 is attached to the underlying two blocks 1 across those blocks. In this situation, the front wheels 4 of the topmost block 1 contact the rear wheels 4 of the underlying front block 1 and the rear wheels 4 of the topmost block 1 contact the front wheels 4 of the underlying rear block 1. Likewise, the individual wheels 4 which are in contact with the topmost wheels 4 contact the wheels 4 of the underlying block 1.

In this assembly too, the entire block assembly can run if the block 1 equipped with the driving device is included as a key block in the assembly. As one modification of this assembly, different blocks 1 may be coupled to the front and back of the topmost block 1, thus providing an inverted pyramid assembly. Alternatively, different blocks 1 may be coupled to the front and back of the lowermost block 1, thus providing a pyramid assembly. If the blocks 1 assembled like a pyramid, particularly, runs on a table, all the wheels 4 rotate so that the block assembly shows a very sophisticated motion and is excellent in deviceability.

FIG. 13 illustrates an assembly in which one block 1 is placed on another, the wheels 4 of two other blocks 1 are coupled to the wheels 4 of the overlying block 1 on both sides, and the fifth block 1 is placed on the topmost position. In this assembly too, the lowermost block 1 can run if the block 1 equipped with the driving device is placed at the topmost position as a key block in the assembly. Thus, the assembled blocks 1 can run. Other blocks 1 may be coupled one by one to the blocks 1 which are coupled to both sides of the intermediate block 1 in a similar manner, thus providing a wing-like block assembly.

By further combining the assemblies as shown in FIGS. 11 to 13, assemblies with a variety of shapes become available. For example, the blocks 1 may be assembled into an airplane-like shape by combining the assembly shown in FIG. 11 and the one shown in FIG. 13. Further, the blocks 1 may be assembled into an inverted pyramid shape or a pyramid shape by combining the assembly shown in FIG. 12 and the one shown in FIG. 13. In the case of such a complex assembly, as the entire block assembly runs, many wheels 4 rotate so that the block assembly shows a very sophisticated motion and is considerably deviceable. If the blocks 1 are assembled like a pyramid, in particular, all the wheels 4 rotate so that the block assembly is excellent in deviceability.

According to this block toy, because the wheels 4 are attached to the block body 2, the user can play running the blocks 1 independently. If the colors and patterns of blocks are designed like those of real automobiles such as sports cars, the individual blocks 1 would show the sense of existence and could also be used as a toy themselves.

Although the wheel coupling section 16 of the wheel 4 is comprised of three fan-shaped fitting projections 17 and three fan-shaped fitting recesses 18 in the first embodiment, the design of the wheel coupling section 16 of the wheel 4 is not limited to this particular type but may be comprised of two fan-shaped fitting projections 17 and two fan-shaped fitting recesses 18. Further, the wheel coupling section 16 of the wheel 4 may be comprised of four or more fan-shaped fitting projections 17 and fan-shaped fitting recesses 18 which are equal in number to the fitting projections 17. The number of the fitting projections and the number of the fitting recesses can be changed. Although the transmission surface 4*a* on the outer surface of the wheel 4 takes the form of embedded multiple grooves in the first embodiment, the transmission surface 4*a* is not limited to this particular type but may be formed by a member like rubber having a high friction coefficient. Although a metal rod is used as the wheel shaft 3 in the first embodiment, the wheel shaft 3 is not limited to this particular type but may be a shaft integrated to the associated attaching section provided at the side or bottom of the block body 2.

The second engage protrusions 14*a*, 14*b*, 15*a* and 15*b* are simply designed to engage with the second engage holes 6*a* and 6*b* in the first embodiment. As an alternative, a claw may be provided at the distal end of each of the second engage protrusions 14*a*, 14*b*, 15*a* and 15*b* and an engage recess to engage with the claw may be provided in each of the second engage holes 6*a* and 6*b*. This modification can enhance the coupling force between the lower second engage protrusions 14*a*, 14*b*, 15*a* and 15*b* with the upper second engage holes 6*a* and 6*b*.

Second Embodiment

A block toy using runnable blocks according to the second embodiment of the present invention will now be described referring to FIGS. 14 through 22.

FIGS. 14 through 18 illustrate a runnable block 30 according to the second embodiment of this invention. The block 30 comprises a block body 31, and four wheels 33 which are attached to both sides of the block body 31 via wheel shafts 32.

Figure 17:
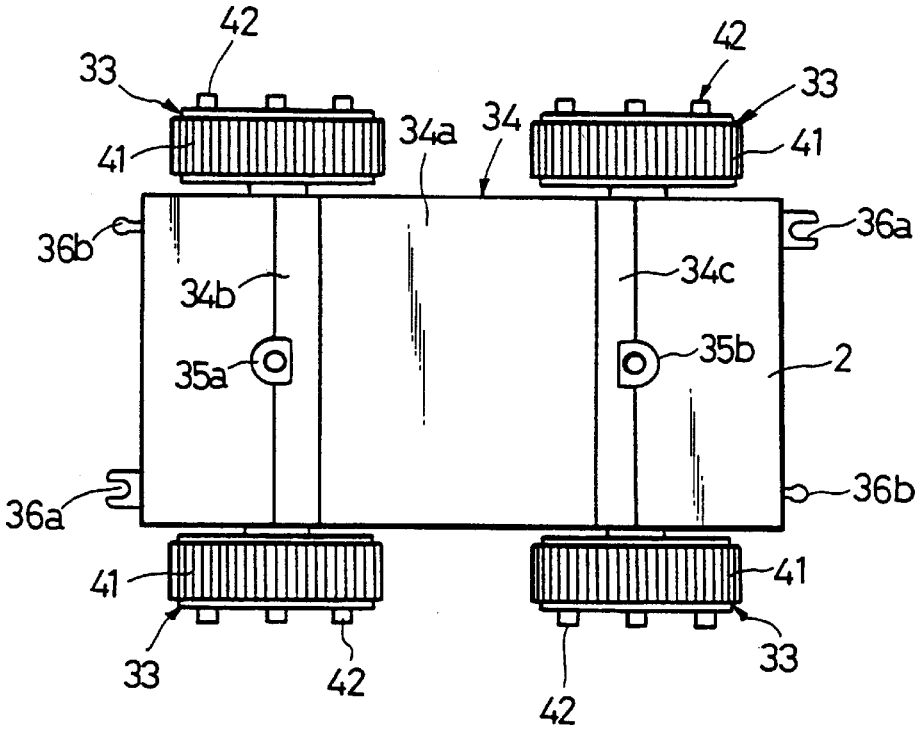
FIG. 17 is a plan view of the block according to the second embodiment of this invention.
Figure 18:
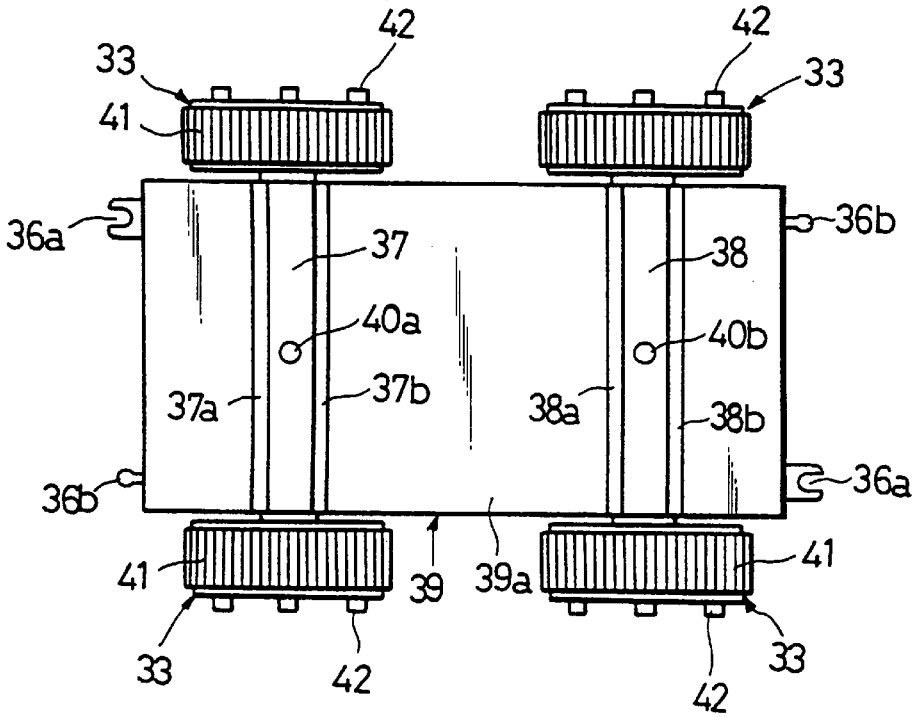
FIG. 18 is a bottom view of the block according to the second embodiment of this invention.

The block body 31 is made of synthesized resin, and is shaped like a vehicle. A first engage projection 34 shaped like the roof of a vehicle is formed at the center of the top of the block body 31. The first engage projection 34 is so tapered that the individual sides form a truncated pyramid, making the top side narrower than the bottom side. Second engage sections 35*a* and 35*b* are respectively provided at the centers of the bottoms of front and rear inclined surfaces 34*a* and 34*c* of the first engage projection 34. Each of the second engage sections 35*a* and 35*b* has a pedestal with a circular recess formed at the center thereof. A block coupling portion 36 is provided in each of the front and rear faces of the block body 31. As shown in FIGS. 17 and 18, the front block coupling portion 36 is comprised of an engage protrusion 36*a* with a recess provided on the left side (bottom side in the diagrams) at the front face (left face in the diagrams) of the block body 31, and an engage protrusion 36*b* with a circular distal end provided on the right side (top side in the diagrams) at the front face of the block body 31. The rear block coupling portion 36 has a engage protrusion 36*a* and a engage protrusion 36*b*, which are provided in a point symmetric fashion to the engage protrusions of the front block coupling portion 36 with respect to the center of the block body 31.

Figure 15:
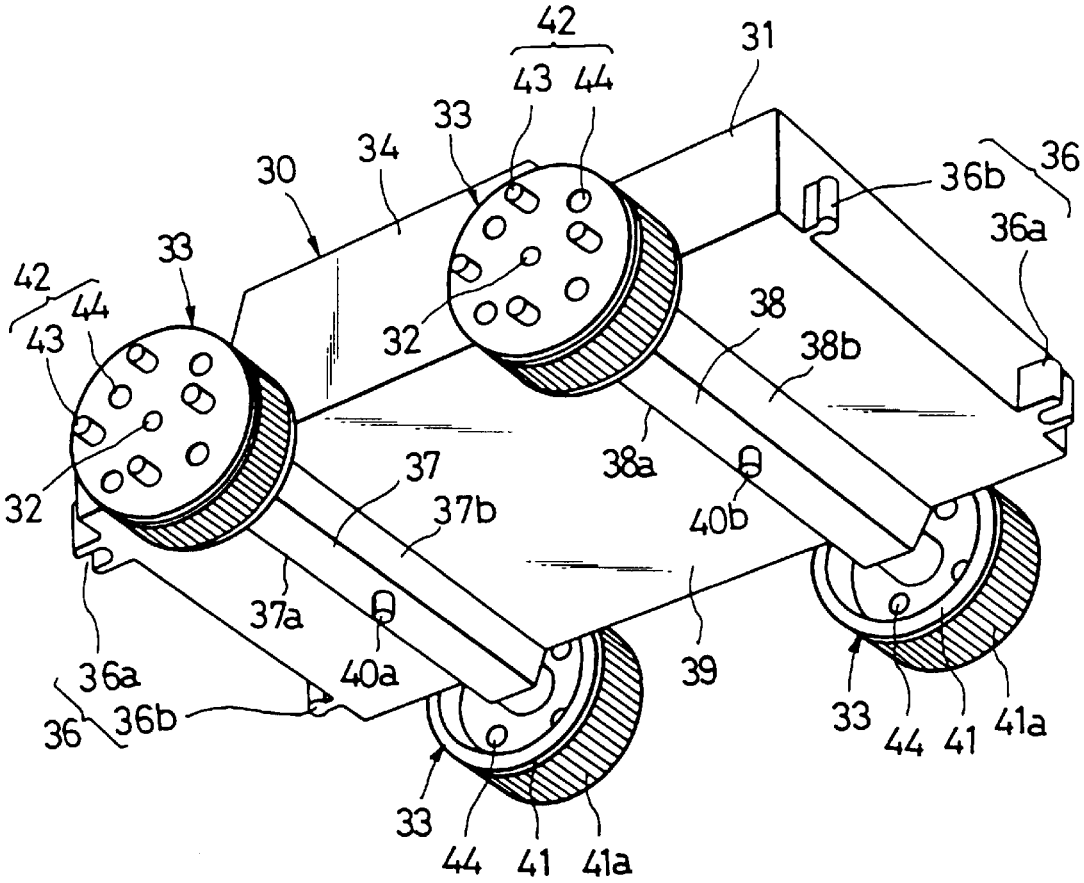
FIG. 15 is a perspective view of the block according to the second embodiment of this invention as viewed from obliquely below.

Wheel-shaft attaching sections 37 and 38 are provided at the bottom of the block body 31 across both widthwise (right and left) ends of the block body 31 as shown in FIGS. 15 and 18. The wheel-shaft attaching sections 37 and 38 are provided so as to contact the front face 34*a* and rear face 34*c* of the first engage projection 34 of an underlying block 30. The wheel-shaft attaching section 37 has a rear face 37*b* inclined at the same angle as the front face 34*b* of the first engage projection 34, and a front face 37*a* inclined at the same angle as the rear face 34*c* of the first engage projection 34. The wheel-shaft attaching section 38 has a front face 38*a* inclined at the same angle as the rear face 34*c* of the first engage projection 34, and a rear face 38*b* inclined at the same angle as the front face 34*b* of the first engage projection 34. Provided between the wheel-shaft attaching sections 37 and 38 at the bottom of the block body 31 is a first engage recess 39 which is to engage with the first engage projection 34 of another block 30. Provided at the center of the bottom of each wheel-shaft attaching section 37 or 38 are second engage protrusions 40*a* and 40*b* which are to engage with the recesses of the second engage sections 35*a* and 35*b* of another block 30.

Figure 14:
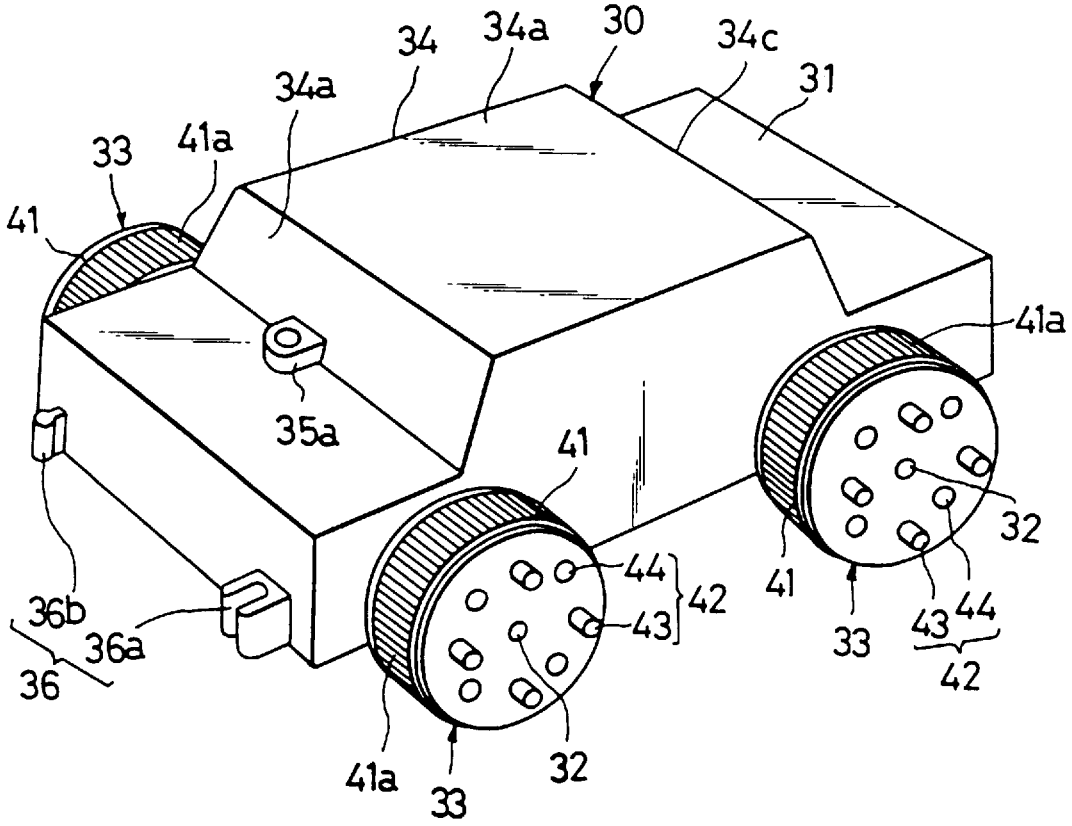
FIG. 14 is a perspective view of a block according to the second embodiment of this invention as viewed from obliquely above.

Wheel shafts 32 are provided on the respective wheel-shaft attaching sections 37 and 38, protruding from the right and left sides of the block body 31. Each wheel shaft 32 is made of a metal rod to whose tip the associated wheel 33 is rotatably attached. A rubber belt 41 is put around the outer surface of each wheel 33. The outer surface of the rubber belt 41 is formed as a power transmission surface 41*a*, which has multiple grooves embedded and transfers power and rotation to another wheels 4. A wheel coupling section 42, which allows the wheels 33 to be coupled together, is provided on the wheel surface of each wheel 33. As shown in FIGS. 14 and 15, each wheel coupling section 42 has four fitting pins 43 and four fitting holes 44 alternately arranged in a ring shape. At the time the wheels 33 are coupled together, therefore, if each fitting pin 43 of one wheel 33 is fitted into the associated fitting hole 44 of another wheel 33, each fitting pin 43 of the latter wheel 33 is simultaneously fitted into the associated fitting hole 44 of the former wheel 33. As a result, the wheels 33 are coupled together with the associated wheels' outer surfaces facing one another.

Figure 16:
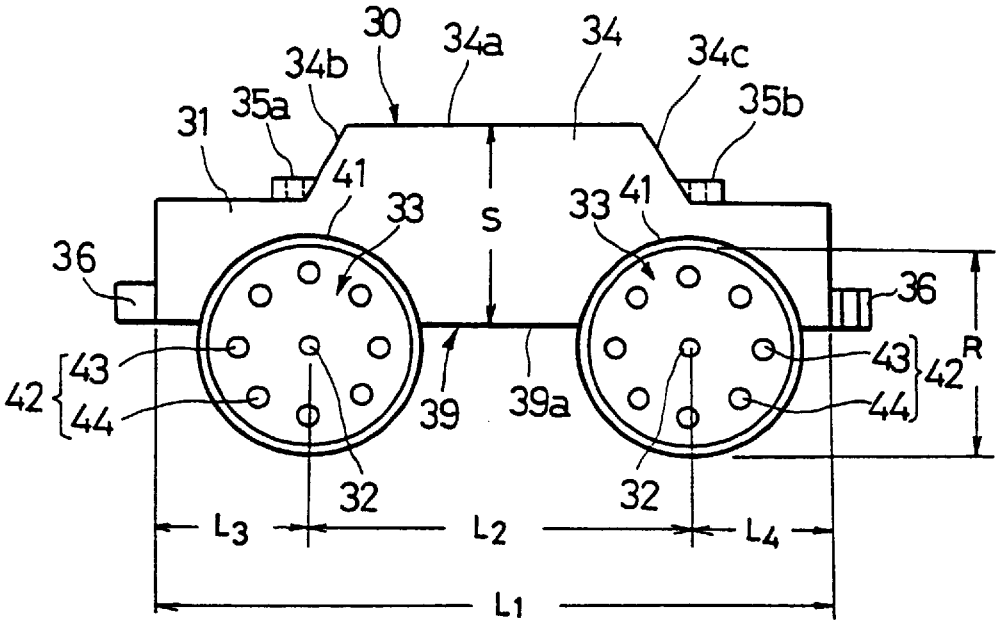
FIG. 16 is a side view of the block according to the second embodiment of this invention.

As shown in FIG. 16, a part of each wheel 33 protrudes below the bottom surfaces of the second engage protrusions 40*a* and 40*b* provided at the bottoms of the wheel-shaft attaching sections 37 and 38. The diameter R of each wheel 33 is set equal to a distance S from the top surface (attaching surface) 34*a* of the upper first engage section 34 of the block body 31 to the bottom surface (attaching surface) 39*a* of the lower engage recess 39 of the block body 31, or is set slightly longer than the distance S. The length $L_1$ of the block body 31 in the forward and backward direction is approximately twice the distance $L_2$ between the wheel shafts ($L_1=L_2\times2$), as shown in FIG. 16. The wheel shaft distance $L_2$ is set approximately equal to the sum of the distance $L_3$ from the front wheel shaft 32 to the front end of the block body 31 and the distance $L_4$ from the rear wheel shaft 32 to the rear end of the block body 31 ($L_2=L_3+L_4$). The distance $L_3$ from the front wheel shaft 32 to the front end of the block body 31 is set substantially equal to the distance $L_4$ from the rear wheel shaft 32 to the rear end of the block body 31 ($L_3\approx L_4$).

The block body 31 of at least one of a plurality of blocks 30 incorporates a driving device for driving the four wheels 33, as per the first embodiment.

Figure 19:
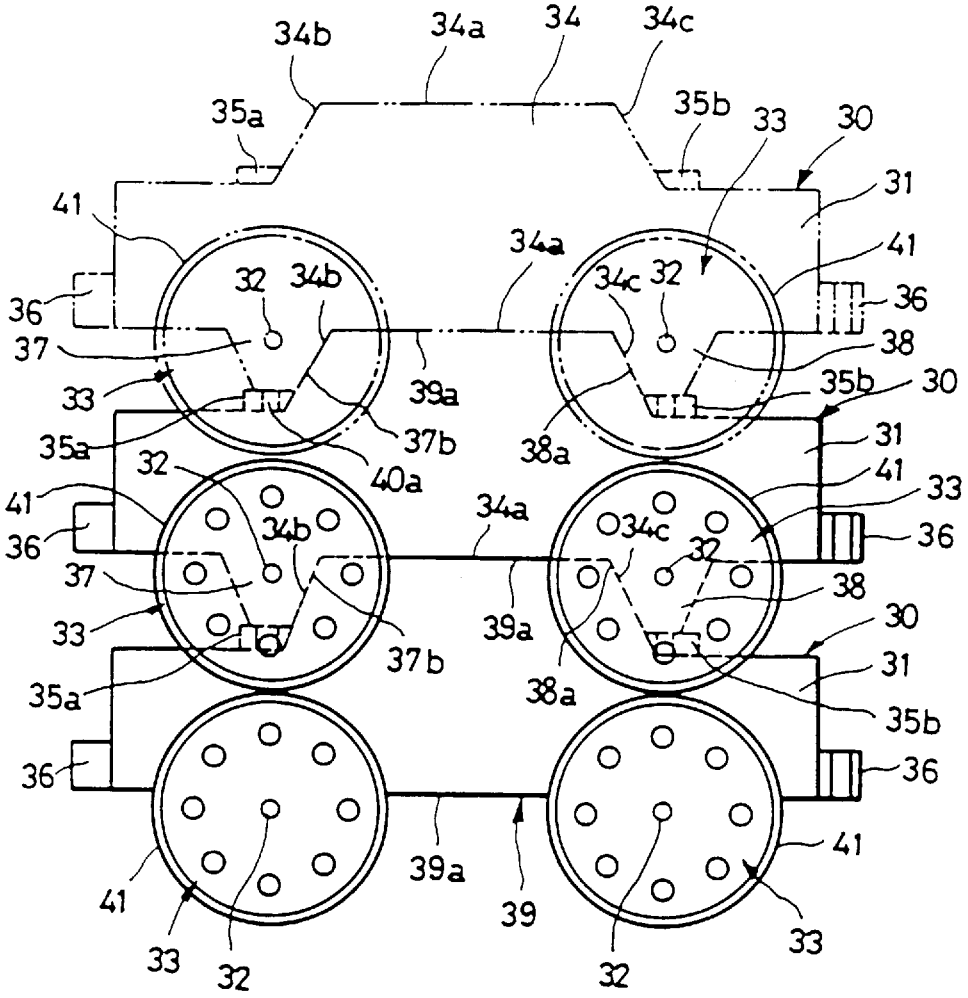
FIG. 19 is a side view showing blocks coupled to one on another according to the second embodiment of this invention.

According to this block toy, as shown in FIG. 19, two blocks 30 can be coupled together by engaging the first engage projection 34 of one block 30 with the first engage recess 39 of the other block 30. In this case, as the first engage recess 39 engages with the first engage projection 34, the second engage protrusions 40*a* and 40*b* provided on the center of the bottom of the wheel-shaft attaching section 37 engage with the second engage sections 35*a* and 35*b* located in the front and at the back of the first engage projection 34. The two blocks 30 can therefore be coupled together surely and firmly.

With two blocks 30 placed one on the other, because the diameter R of each wheel 33 is set substantially equal to the distance S from the top surface 34*a* of the first engage section 34 to the bottom surface 39*a* of the first engage recess 39, the rubber belts 41 put around the outer surfaces of the wheels 33 of the overlying and underlying blocks 30 contact each other, as per the first embodiment. As the wheels 33 of either the overlying block 30 or those of the underlying one rotate, therefore, the rotation is transferred to the wheels 33 of the other block 30. As a part of each wheel 33 is protruding below the lowermost surface of the block body 31, the user can place the block 30 on a table or the like and run it thereon, as per the first embodiment. In running vertically coupled blocks 30, the wheels 33 of the overlying block 30 rotate in accordance with the rotation of the wheels 33 of the underlying block 30. Therefore, the assembly of the coupled blocks 30 shows a sophisticated motion and is excellent in deviceability.

Because the rubber belt 41 is put around the outer surface of the wheel 33 and multiple grooves are embedded in the rubber belt 41 to serve as the transmission surface 41*a*, when the block 30 runs on a table or the like, the wheels 33 roll without skidding on the table or the like. If one of two blocks 30 is equipped with the driving device, the two blocks 30, one overlying the other, can automatically run. Even if the block 30 equipped with the driving device is placed at the uppermost position at the time of three or more blocks 30 are put one another as indicated by the two-dot chain line in FIG. 19, the rotation of the wheels 33 of the uppermost block 30 driven by the driving device is transferred to the wheels 33 of the lowermost block 30 so that the assembled blocks 30 can automatically run on a table or the like. The assembled blocks 30 can run similarly regardless of where the block 30 equipped with the driving device is positioned, as per the first embodiment.

Figure 20:
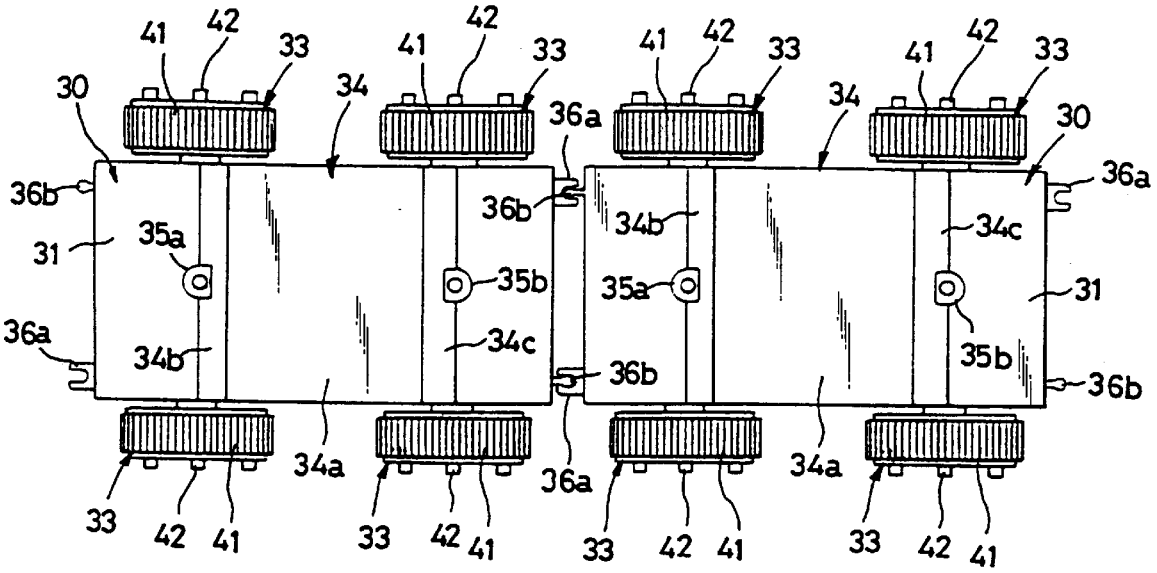
FIG. 20 is a plan view showing one block coupled to the front of the other according to the second embodiment of this invention.

As mentioned earlier, the block coupling portions 36 are provided at the front and rear faces of the block body 31. Therefore, blocks 30 can be coupled together in a line, one in front of or at the back of another, by connecting the front and rear block coupling portions 36 of one block 30 to the front and rear block coupling portions 36 of another block 30, as shown in FIG. 20. As the two projection pieces 36*a* and 36*b* of the block coupling portion 36 of one block 30 are respectively engaged with the projection pieces 36*b* and 36*a* of the block coupling portion 36 of another block 30, the block bodies 31 can be coupled together. To disconnect the blocks 30 from each other, the engage protrusions 36*a* and 36*b* should be pulled away against the engaging force of the circular engage protrusion 36*b* and the recessed engage protrusion 36*a*.

Figure 21:
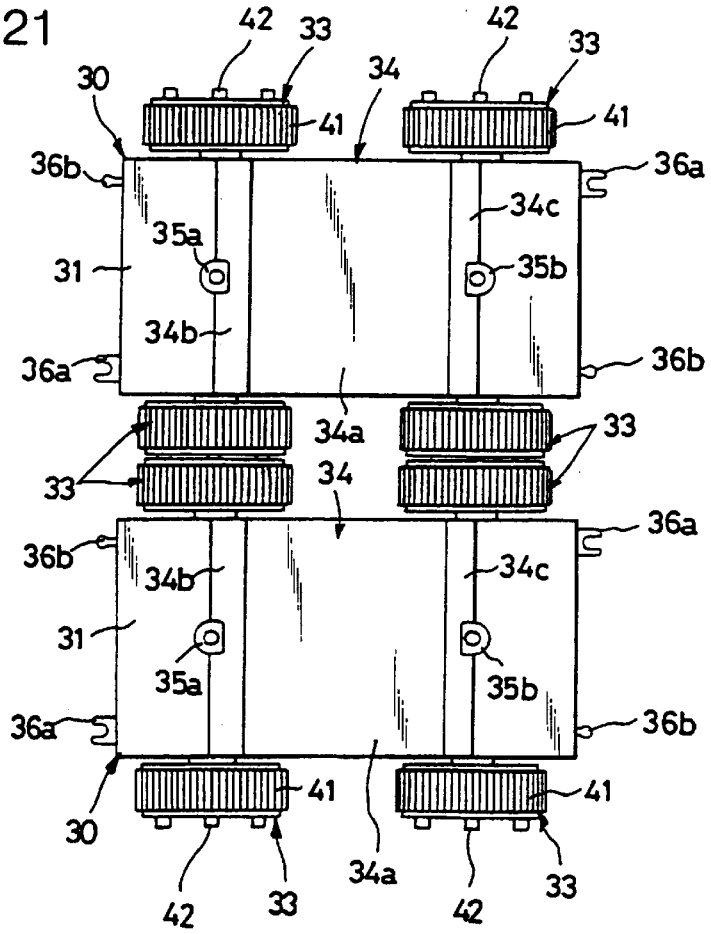
FIG. 21 is a plan view showing blocks coupled sideways to each other according to the second embodiment of this invention.

The wheel coupling section 42 is provided on the wheel surface of each wheel 33 of this block 30. Blocks 30 are arranged side by side so that the wheels 33 on one side of one block 30 face those of the other block 30, and the individual fitting pins 43 of the wheel coupling sections 42 of one block 30 are fitted in the associated fitting holes 44 of the wheel coupling sections 42 of the other block 30. As a result, the wheels 33 of the two blocks 30 can be coupled together, as shown in FIG. 21. For example, two blocks 30 may be arranged symmetrical side by side so that two wheels 33 of one block 30 are coupled to two wheels 33 of the other block 30. Two blocks 30 may be so arranged with one block 30 shifted frontward by about a half length so that only one wheel 33 of one block 30 is coupled to one wheel 33 of the other block 30. The number of blocks 30 to be coupled is not limited to two, but multiple blocks 30 may be coupled one by one in the same manner. Further, with one block 30 coupled to the front of another as shown in FIG. 20, the wheels 33 of the third block 30 may be coupled to one wheel 33 of the front block 30 and one wheel 33 of the back block 30. Multiple blocks 30 coupled in this manner can run side by side in an integral form as per the first embodiment.

Figure 22:
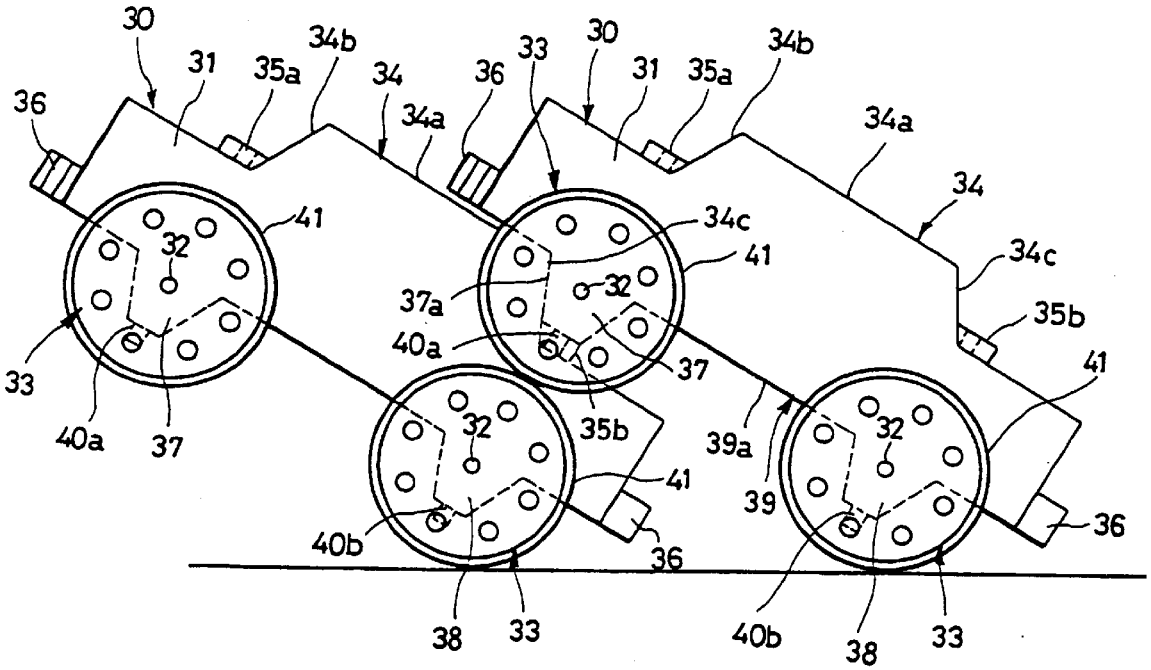
FIG. 22 is a side view showing one block coupled to another and shifted frontward, according to the second embodiment of this invention.

In coupling one block 30 on another block 30, the former block may be shifted forward or backward by some length as per the first embodiment. To place one block 30, shifted rearward (rightward in FIG. 22), on another block 30, the front face 37*a* of the wheel-shaft attaching section 37 of the overlying block 30 should contact the rear face 34*c* of the first engage projection 34 of the underlying block 30 to engage the second engage protrusion 40*a* of the overlying block 30 with the second engage section 35*b* of the underlying block 30, as shown in FIG. 22. In this assembly, the two blocks 30 are coupled together with the rear wheels 33 of the underlying block 30 being in contact with the front wheels 33 of the overlying block 30. In this case, as shown in FIG. 22, the individual blocks 30 can be tilted with the front side facing upward as in the first embodiment, and the entire block assembly becomes stable with the rear wheels 33 of the underlying block 30 and the rear wheels 33 of the overlying block 30 being in contact with the top of the table.

If one block 30 is coupled to another block 30 in a forward shifted fashion (leftward in FIG. 22), for example, the rear face 38*b* of the wheel-shaft attaching section 38 of the overlying block 30 should contact the front face 34*b* of the first engage projection 34 of the underlying block 30 so that the lower second engage protrusion 40*b* of the overlying block 30 is engaged with the second engage section 35*a* of the underlying block 30. In this case, the upper and lower blocks 30 can be tilted with the front side facing downward and the entire block assembly becomes stable while the front wheels 33 of the underlying block 30 and the front wheels 33 of the overlying block 30 are in contact with the table.

Even when the coupled blocks 30 become stable in a tilted fashion with the front side facing upward or downward, the coupled blocks 30 can run well on the table. The number of blocks 30 to be coupled is not limited to two, but an arbitrary number of blocks 30 can be placed one on another.

The same assemblies as provided by the first embodiment become available by combining the aforementioned various assemblies.

For example, as shown in FIG. 11 of the first embodiment, a plurality of blocks 30 may be placed on one block 30 and other blocks 30 may be coupled to the front and back of the underlying block 30 by means of the block coupling portions 36. In this assembly, as in the first embodiment, the entire block assembly can run if the block 30 equipped with the driving device is included as a key block in the assembly. Because all the wheels 33 rotate when the block assembly runs, the block assembly shows a very sophisticated motion and has an excellent deviceability. The same advantage can be acquired regardless of the location of the block 30 equipped with the driving device in the assembly.

It is however desirable that the block 30 with the driving device should be placed at the position (e.g., the topmost position, the rear most position, or the frontmost position) where it is easy for the user to operate a switch (SW) of the driving device.

As in the assembly example of the first embodiment shown in FIG. 12, two blocks 30 may be placed on one block 30, and the fourth block 30 is placed on those two overlying blocks 30. In this case, the second engage protrusion 40*a* at the front end of the topmost block 30 is engaged with the recess of the second engage section 35*b* of the underlying front (left in FIG. 12) block 30. The second engage protrusion 40*b* at the rear end of the topmost block 30 is engaged with the recess of the second engage section 35*a* of the underlying rear (right in FIG. 12) block 30. The topmost block 30 is attached to the underlying two blocks 30. In this situation, the front wheels 33 of the topmost block 30 contact the rear wheels 33 of the underlying front block 30 and the rear wheels 33 of the topmost block 30 contact the front wheels 33 of the underlying rear block 30. Likewise, the individual wheels 33 which are in contact with the topmost wheels 33 contact the wheels 33 of the underlying block 30. In this assembly too, the entire block assembly can run if the block 30 equipped with the driving device is included as a key block in the assembly as per the first embodiment. In this assembly, the blocks 30 may be assembled like an inverted pyramid or a pyramid.

As shown in FIG. 13 of the first embodiment, one block 30 may be placed on another, the wheels 33 of two other blocks 30 may be coupled to the wheels 33 of the overlying block 30 on both sides, and the fifth block 30 may be placed on the topmost position. In this case, the whole block assembly can run if the block 30 equipped with the driving device is placed as a key block in the assembly.

By further combining those assemblies, assemblies with a variety of shapes become available as per the first embodiment.

Although the wheel coupling section 41 of the wheel 33 is comprised of four fitting pins 42 and four fitting holes 43 in the second embodiment, the design of the wheel coupling section 41 is not limited to this particular type but may be comprised of three or less fitting pins and three or less fitting holes, or five or more fitting pins and fitting holes which are equal in number to the fitting pins. The number of the fitting pins and the number of the fitting holes can be changed. Although the transmission surface 41*a* is formed by embedding multiple grooves in the outer surface of the wheel 33, the transmission surface 41*a* should not necessarily have multiple grooves. If the rubber belt 41 or the like which has a high frictional coefficient is used, it may be used directly without any processing. Although a metal rod is used as the wheel shaft 32 in the second embodiment, the wheel shaft 32 is not limited to this particular type but may be a shaft integrated to the associated attaching section provided at the side or bottom of the block body 31. The second engage protrusions 40*a* and 40*b* of the block body 31 are simply designed to engage with the second engage sections 35*a* and 35*b* of the block body 31 in the second embodiment. As an alternative, an engage groove may be formed at the distal end of each of the second engage protrusions 40*a* and 40*b* and an engage projection to engage with the engage groove may be formed on the inner surface of each of the recesses of the second engage sections 35*a* and 35*b*. Accordingly, the coupling force between the second engage protrusions 40*a* and 40*b* with the second engage sections 35*a* and 35*b* can be enhanced by engaging the engage grooves of the second engage protrusions 40*a* and 40*b* with the engage projections of the second engage sections 35*a* and 35*b*.

This invention is not limited to the above-described first and second embodiments, but may be embodied in various other forms as shown in FIGS. 23 through 27.

Figure 23:
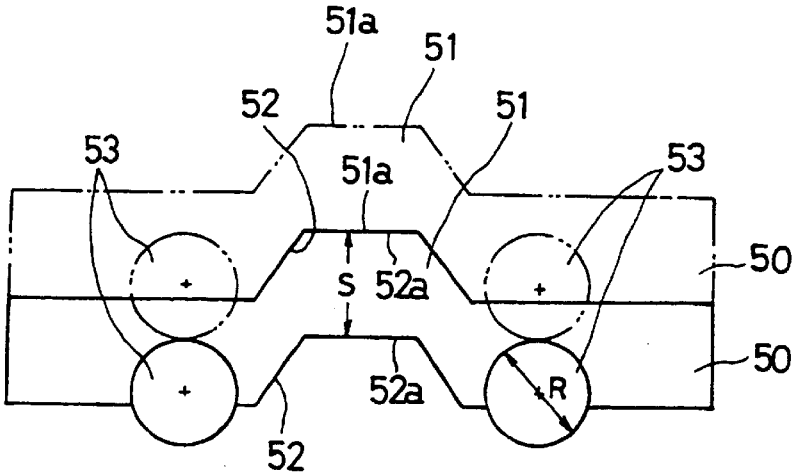
FIG. 23 is a diagram showing a first modification of the block embodying this invention.
Figure 24:
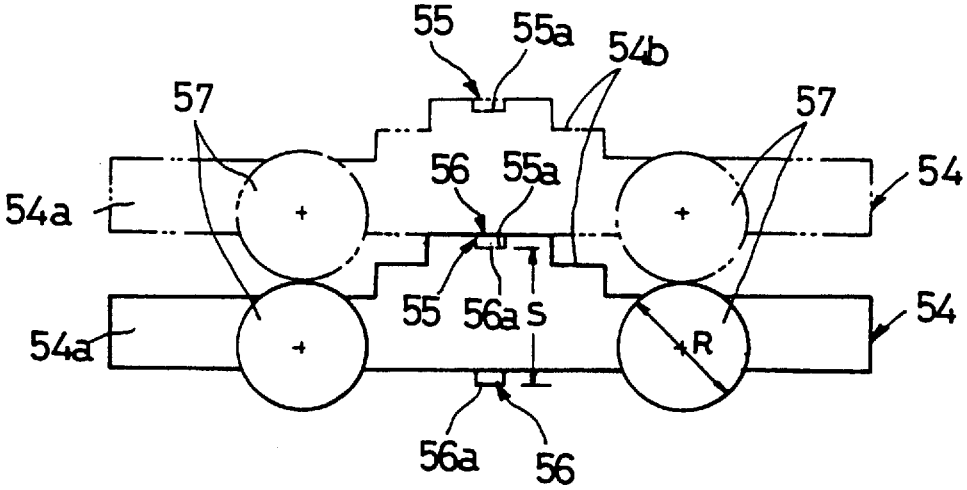
FIG. 24 is a diagram showing a second modification of the block embodying this invention.
Figure 25:
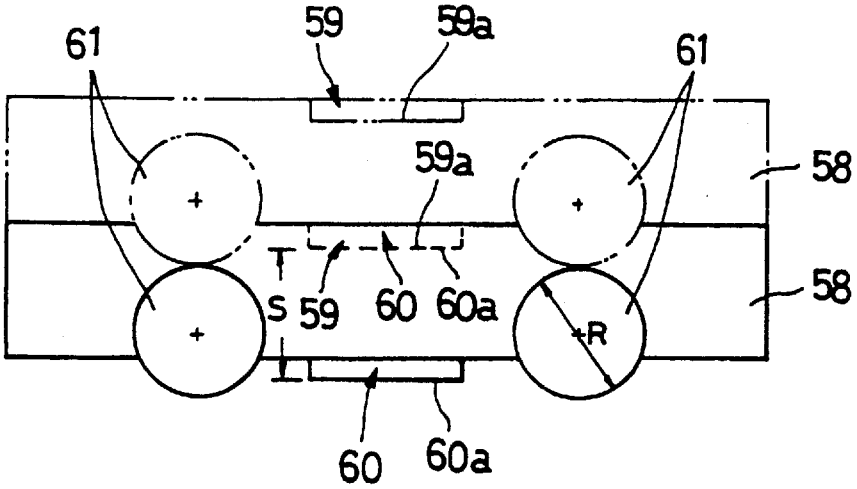
FIG. 25 is a diagram showing a third modification of the block embodying this invention.

Although the roofs of the car-shaped block bodies 1 and 30 are used as the first engage projections 5 and 34 in those embodiments, the structures as shown in FIGS. 23 to 25 may be used instead.

The entire roof portion of a car-shaped block body 50 may be used as an engage projection 51 and an engage recess 52 which is engageable with the engage projection 51 may be provided at the bottom of the block body 50 as in the first modification shown in FIG. 23. In this case too, a part of each of wheels 53 on the sides of the block body 50 should protrude below the lowermost surface of the block body 50 and the diameter R of each wheel 53 should be set substantially equal to the distance S from the topmost surface 51*a* of the upper engage projection 51 to the top surface 52*a* of the lower engage recess 52.

Figure 27:
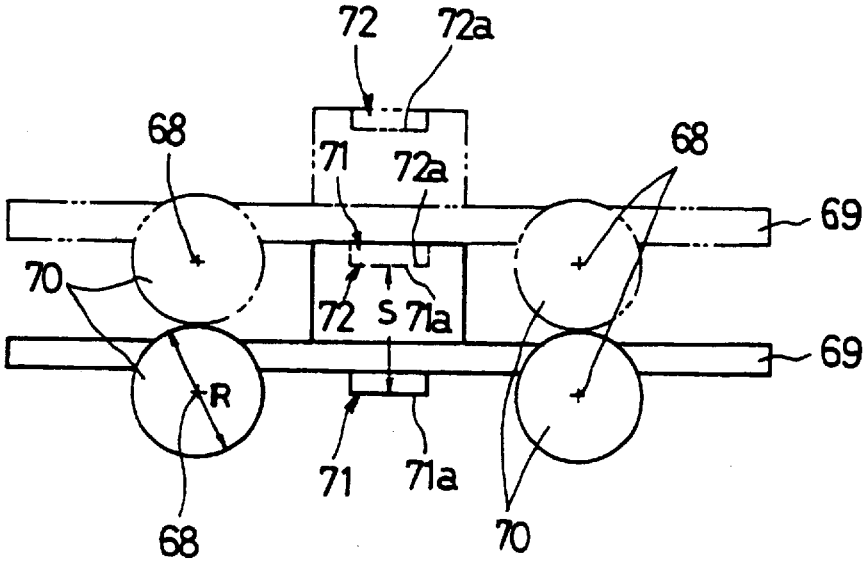
FIG. 27 is a diagram showing a fifth modification of the block embodying this invention.

As in the second modification shown in FIG. 24, a block body 54 may be comprised of a pedestal 54*a* and a step-shaped projection 54*b* on the top of which an upper engage recess 55 is provided, and an engage projection 56 engageable with the engage recess 55 may be provided at the bottom of the pedestal 54*a*. In this case, the pedestal 54*a* may be a thick flat plate, or a thin flat plate as shown in FIG. 27. In this modification too, a part of each wheel 57 on each side of the block body 54 should protrude below the lower end face of the lower engage projection 56 and the diameter R of each wheel 57 should be set substantially equal to the distance S from the bottom 55*a* of the upper engage recess 55 to the lower end face 56*a* of the lower engage projection 56. As long as the relationship between the diameter R of the wheel 57 and the distance S is satisfied, the block body 54 may have the step-like projection 54*b* provided at the bottom.

As in the third modification shown in FIG. 25, the top and bottom surfaces of a block body 58 may be formed flat, an engage recess 59 may be formed on the top surface, and an engage projection 60 engageable with the engage recess 59 may be provided at the bottom of the block body 58. In this modification too, a part of each wheel 61 on each side of the block body 58 should protrude below the lower end face of the lower engage projection 60 and the diameter R of each wheel 61 should be set substantially equal to the distance S from the bottom 59*a* of the engage recess 59 to the lower end face 60*a* of the engage projection 60. As long as the relationship between the diameter R of the wheel 61 and the distance S is satisfied, the block body 58 may have the engage recess 59 formed on the bottom and the engage projection 60 formed on the top.

Figure 26:
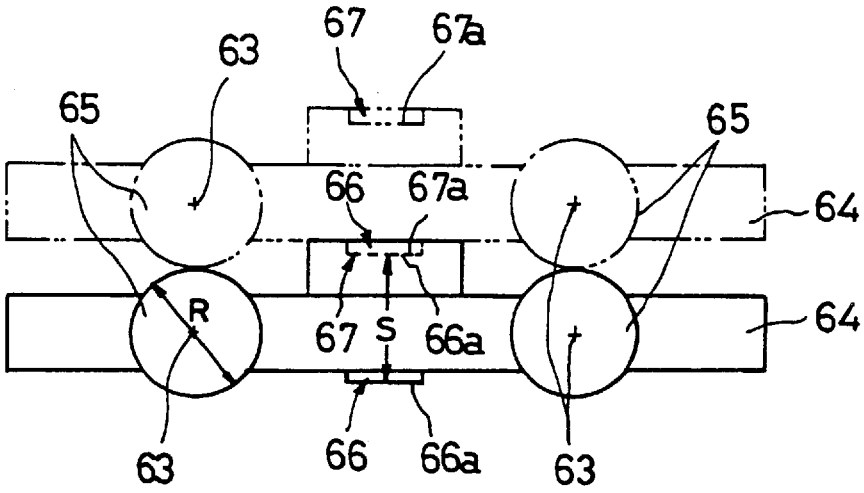
FIG. 26 is a diagram showing a fourth modification of the block embodying this invention.

Although the wheel shafts 3 and 32 are provided at the positions of the bottom surfaces of the block bodies 1 and 30 in the above-described embodiments, this invention is not limited to this design, and the wheel shafts may be provided at the position shown in FIG. 26 or FIG. 27. Wheel shafts 63 may be provided at intermediate positions between the top and bottom surfaces of a block body 64, i.e., above the bottom of the block body 64 as in the fourth modification shown in FIG. 26. In this modification, a part of each wheel 65 should protrude below an engage projection 66 and the diameter R of each wheel 65 should be set substantially equal to the distance S from the bottom 67*a* of an upper engage recess 67 to the lower end face 66*a* of the engage projection 66. As in the fifth modification shown in FIG. 27, wheel shafts 68 may be provided below the bottom surface of a block body 69. In this modification, a part of each wheel 70 should protrude below an engage projection 71 and the diameter R of each wheel 70 should be set substantially equal to the distance S from the bottom 72*a* of an upper engage recess 72 to the lower end face 71*a* of the engage projection 71.

Third Embodiment

The third embodiment of this invention will now be described with reference to FIGS. 28 and 29.

Because the basic structure of a block according to this embodiment is the same as that of the block according to the first embodiment shown in FIGS. 1 and 2, the following will mainly discuss the characterizing portions of the third embodiment.

Figure 28:
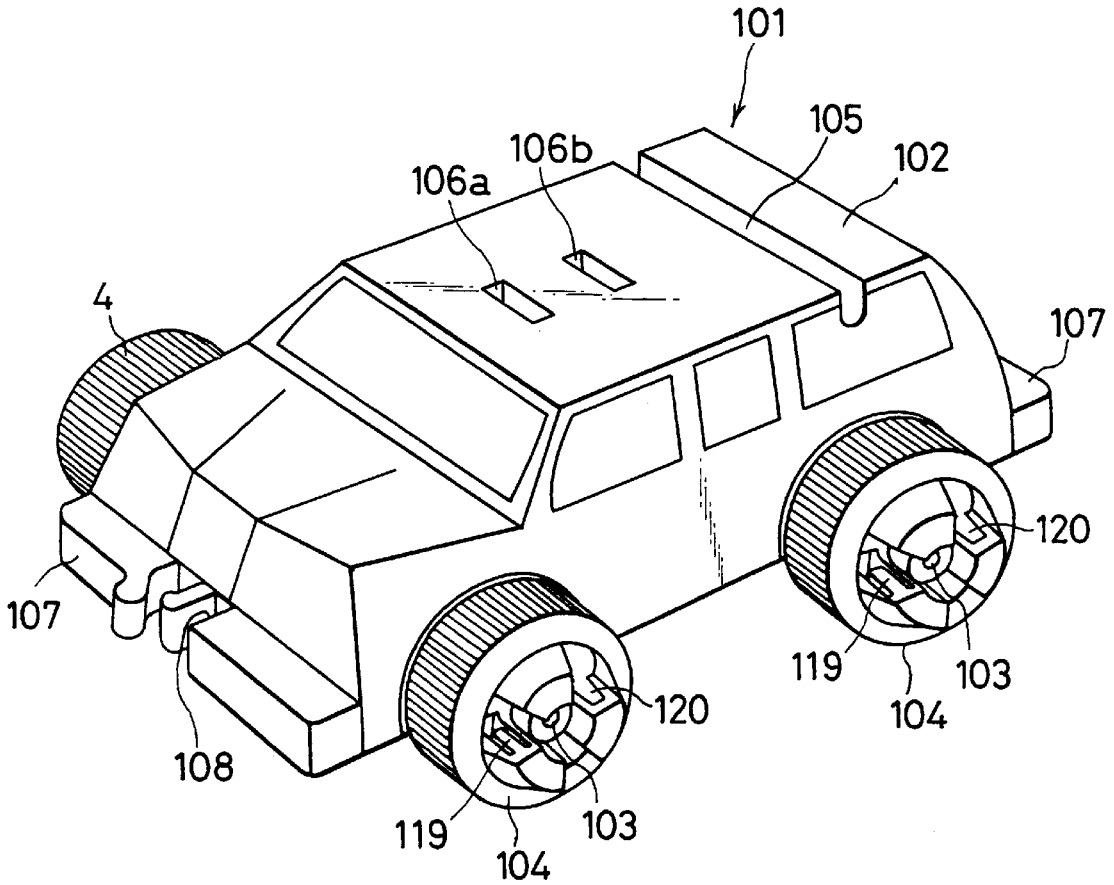
FIG. 28 is a perspective view of a block according to the third embodiment of this invention.
Figure 29:
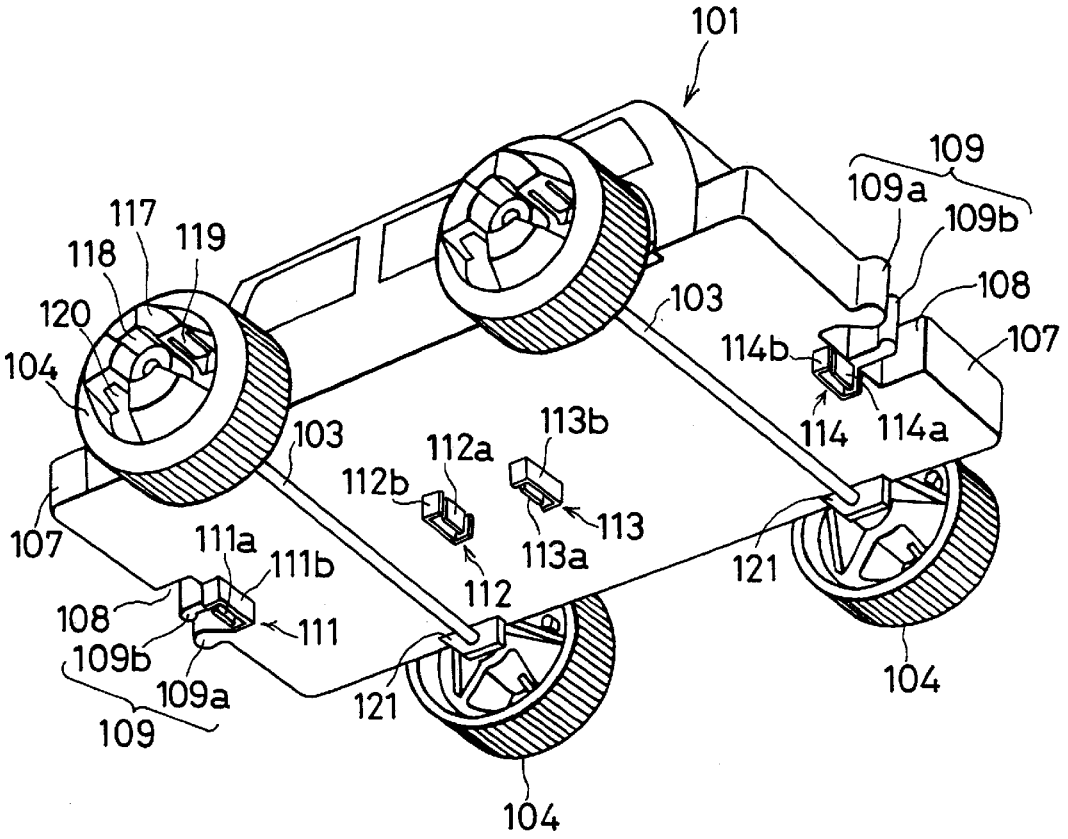
FIG. 29 is a perspective view of the block according to the third embodiment as viewed from below.

A block 101 of this embodiment has a block body 102 designed like a van type vehicle, as shown in FIG. 28. The top portion of the block body 102, which corresponds to the roof of a vehicle, unlike that of the first embodiment, is not coupled to another block.

Provided on the top of the block body 102 are engage holes 106*a* and 106*b* with which engage protrusions 111 to 114 engage are formed on the bottom of another block 102.

Further provided on the rear top portion of the block body 102 is a wheel-shaft retainer 105 for receiving a wheel shaft 103 (which will be discussed later) when another block 102 is placed on this block body 102.

Bumper sections 107 are provided at the front and rear faces of the block body 102. A recess 108 is formed in the center portion of each bumper section 107, with a block coupling portion 109 provided in the recess 108. The block coupling portion 109 has a projection piece 109*a* protruding from the distal end face of each bumper section 107 and a projection piece 109*b* which is substantially flush with the bumper section 107. The projection piece 109*a* has a round distal end expanding toward the projection piece 109*b*. The projection piece 109*b* likewise has a round distal end expanding toward the projection piece 109*a*.

In connecting a plurality of block bodies 102 together, one to the front or back of another, the projection piece 109*a* of each block body 102 should be caught between the projection pieces 109*a* and 109*b* of the mating block body 102 and the same should be repeated for other blocks 101.

Provided on the bottom of the block body 102 at the front end, the rear end and the center portion are the engage protrusions 111 to 114 which engage with the associated engage holes 106*a* and 106*b* formed on the top of another block 102.

The engage protrusions 111–114 have engage pieces 111*a* to 114*a* and support pieces 111*b* to 114*b*, respectively. Each of the engage pieces 111*a*–114*a* has a claw-like distal end which slightly expands in a circular form toward the opposite side of the associated one of the support pieces 111*b*–114*b*. Each of the support pieces 111*b*–114*b* has side pieces on both sides, one on each side, so that the support pieces 111*b*–114*b* have a higher rigidity than the engage pieces 111*a*–114*a*.

When each of the engage protrusions 111–114 is inserted into the engage hole 106*a* or 106*b*, the associated one of the support pieces 111*b*–114*b* is supported by the side wall of the engage hole 106*a* or 106*b* and the round distal end portion of the associated engage piece 111*a*, 112*a*, 113*a* or 114*a* is caught in the engage hole 106*a* or 106*b*. As a result, two block bodies 102 are coupled together. When both block bodies 102 are pulled with certain force, the engage piece 111*a*, 112*a*, 113*a* or 114*a* deforms to release the engagement.

The wheel shafts 103 made of metal rods or the like are rotatably attached to the bottom of the block body 102 via wheel support portions 121. Wheels 104 are fixed to both ends of each wheel shaft 103.

Multiple grooves are formed in the outer surface of each wheel 104. A wheel coupling section for allowing one wheel 104 to be coupled to another wheel 104 is provided on the wheel surface of each wheel 4. This wheel coupling section has three fan-shaped fitting projections 117 and three fan-shaped fitting recesses 118.

A spring piece 119 is formed by cutting, on each continuous surface between each fitting projection 117 and each fitting recess 118. When the wheels 104 are coupled together, the distal ends of the spring pieces 119 are urged in a direction to elastically contact with each other. A cutaway 120 is formed in each wheel 104 at the portion on which the distal end of the spring piece 119 abuts when this wheel 104 is coupled to another wheel 104. When the wheels 104 are coupled together, the distal end of the spring piece 119 is caught in the cutaway 120 of another wheel 104.

In this embodiment, the diameter of the wheel 104 is set to such a size that the wheels of one block contact those of another block placed on the former block, respectively.

A plurality of blocks 101 can be placed one on another as in the example illustrated in FIG. 7 by engaging the center engage protrusions 112 and 113 of one block 101 are engaged with the engage holes 106*a* and 106*b* of another block 101. At this time, the front wheel shaft 103 of the overlying block 101 is located in front of the front panel of the underlying block 101, and the rear wheel shaft 103 of the overlying block 101 is retained in the wheel-shaft retainer 105 of the underlying block 101.

A plurality of blocks 101 can be coupled to one on the other, one shifted by some length from the other, by engaging the engage protrusion 111 or 114 of one block 101 at the front end or the rear end thereof with the engage hole 106*a* or 106*b* of another block 101, as in the example illustrated in FIG. 10.

A plurality of blocks 101 may be coupled together, one to the front or back of another, as in the example shown in FIG. 8 by coupling the block coupling portions 109 of those blocks 101 together.

The wheels 104 of a plurality of blocks 101 may be coupled together as per the examples shown in FIGS. 9 and 13.

In the first to third embodiments, the engagement of the engage sections is not limited to the means of an engage member, but may be accomplished by a fitting member, a magnet, tape, an adhesive, or the like.

Figure 30A:
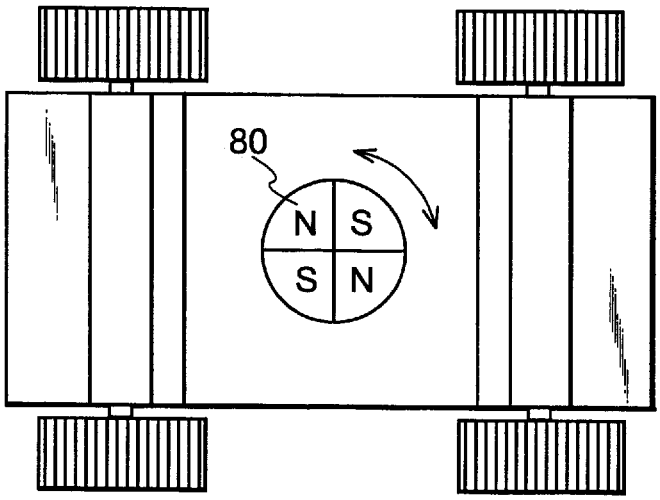
FIG. 30A is a diagram showing a block incorporating a magnet.
Figure 30B:
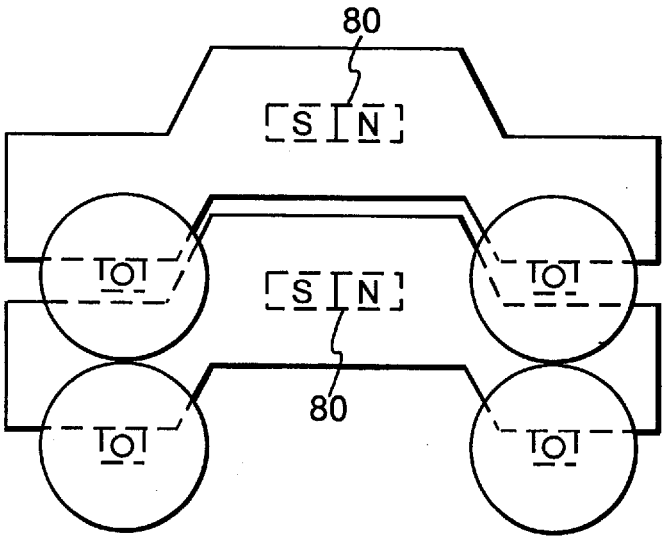
FIG. 30B is a diagram showing two magnet-incorporating blocks coupled to one on the other.

Although each of the upper and lower first engage sections, the upper and lower second engage sections, the block coupling portion and the wheel-shaft attaching section is accomplished by a recess or a projection or the combination of both in the individual embodiments, individual blocks incorporating with magnets may be coupled. In this case, while the magnets of the blocks may simply have the N and S poles, it is desirable that a magnet assembly 80 having a plurality of magnet pieces having the N and S poles as shown in FIGS. 30A and 30B should be used. It is further desirable that a magnet assembly having a plurality of magnet pieces with invertible N and S poles should be incorporated in a movable fashion as illustrated in FIGS. 30A and 30B. In the case where the magnet assembly 80 is incorporated in each block body in this manner, at the time the blocks are coupled together by the attraction of the magnets, it is unnecessary to consider the directions of the magnets. This design can therefore enhance the degree of freedom of the connection of the blocks.

Figure 31:
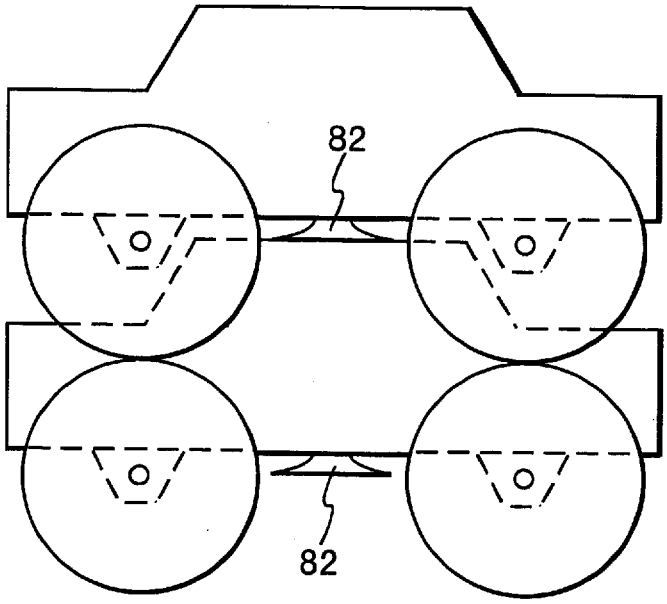
FIG. 31 is a diagram showing blocks with suckers, coupled to one on the other.

Individual blocks may be coupled by using suckers 82 as shown in FIG. 31. In this case, at least one of two blocks to be coupled should be equipped with the sucker 82. Alternatively, the individual blocks may be coupled by using tape or an adhesive.

While the front sides of the blocks are aligned in the foregoing descriptions of the individual embodiments and various modifications for the sake of descriptive convenience, the front and back sides of the blocks may be assembled as well.

In short, according to this invention, the engage sections for permitting blocks to be coupled together are provided on the top and bottom surfaces of the block body, so that as the upper engage section of one block is coupled to the lower engage section of another block, those blocks can be coupled to one on another. Because the diameter of each wheel is set approximately equal to the distance from the top of the first engage projection to the distance to the bottom of the first engage recess, at the time blocks are placed one on another, the outer surfaces of the wheels of the upper block contact those of the associated wheels of the lower block. As the wheels of one of the upper and lower blocks rotate, therefore, the wheels of the other block also rotate. Moreover, a part of each wheel protrudes below the lowermost surface including the lower engage section of the block body. As the user places the assembled blocks on a table or the like and moves the assembly, therefore, the upper wheels as well as the lower wheels rotate simultaneously. The assembly of the coupled blocks would show a sophisticated motion and would be excellent in deviceability. As wheels are attached to each block body, the user can play running the blocks independently. If the blocks are specifically designed, the individual blocks would show the sense of existence and could thus be used as a toy themselves.

What is claimed is:

1. A block toy having at least two runnable blocks, wherein each of said runnable blocks comprises:

a block body having upper and lower engage sections respectively provided on top and bottom surfaces of said block body and being engageable with respective engage sections of another block body; and a plurality of wheels rotatably attached to both sides of said block body, whereby a part of each of said wheels protrudes farther downward than a lowermost surface of said block body, and wherein when other block bodies are coupled to a top and bottom of one block body, respectively, a diameter of each wheel is set approximately equal to a distance from an attaching surface of said upper engage section to said lower engage section of said other runnable block located above said one block body, and to an attaching surface of said lower engage section to said upper engage section of said other runnable block located below said one block body.

2. The block toy according to claim 1, wherein when said upper engage section of said one runnable block is engaged with said lower engage section of said other runnable block located above said one runnable block, thereby locating said block body of said other runnable block on said block body of said one runnable block, outer surfaces of said wheels of said one runnable block mutually contact outer surfaces of said wheels of said other runnable block located above said one runnable block.

3. The block toy according to claim 2, wherein said outer surfaces of said wheels are formed as transmission surfaces for transmitting rotation of one wheel to another wheel while the upper and lower wheels mutually contact each other.

4. The block toy according to claim 1, wherein a wheel surface of each of said wheels includes a wheel engage portion for permitting said wheels of two runnable blocks to be disengageably coupled to each other.

5. The block toy according to claim 1, wherein each said block body has a front face and a rear face, and a block coupling portion, for connection to runnable blocks located at least one of forward and backward of said block body, provided on at least one of the front face and the rear face of said block body.

6. The block toy according to claim 5, wherein a wheel surface of each of said wheels includes a wheel engage portion for permitting said wheels of the runnable blocks to be disengageably coupled to each other.

7. The block toy according to claim 1, wherein opposing wheels on each of said block bodies are coupled together using wheel shafts, and wherein a length of said block body in a forward and backward direction is approximately twice a distance between said wheel shafts, which is set approximately equal to a sum of a distance from a front wheel shaft to a front end of said block body, and a distance from a rear wheel shaft to a rear end of said block body.

8. The block toy according to claim 1, wherein said engage sections are provided on substantially center portions of top and bottom surfaces of said block body, respectively.

9. The block toy according to claim 1, wherein said engage sections have upper and lower first engage sections provided approximately at a center of the top and bottom surfaces of said block body, respectively.

10. The block toy according to claim 9, wherein said engage sections further have lower second engage sections, provided on at least one of a front side and a rear side of said bottom surface of said block body with respect to the center of said bottom surface, and upper second engage sections provided on the top surface of said block body, said lower second engage sections being engageable with at least one of said upper first engage sections and said upper second engage sections of another runnable block, said upper second engage sections being engageable with at least one of said lower first engage sections and said lower second engage sections of another runnable block.

11. The block toy according to claim 1, wherein the upper engage section is formed in one of a shape of a projection, a recess, and a shape of a combination of said projection and recess, and the lower engage section is formed in one of a shape of a recess, a projection, and a shape of a combination of said recess and projection, which is mateable with said one of a projection, recess, and combination of said projection and recess.

12. The block toy according to claim 6, wherein said engage sections, said block coupling portions and said wheel engage portions are any one of an engage member, a fitting member, and a sucker.

13. The block toy according to claim 2, wherein at least one of said block bodies is provided with a driving device for driving said wheels.

14. The block toy according to claim 1, wherein when a plurality of blocks are coupled one on another, said wheels of an overlying block contacting at least one of said wheels of an underlying block.

15. A runnable block comprising:

a block body having upper and lower engage sections respectively provided on top and bottom surfaces of said block body and being engageable with respective engage sections of other block bodies which are substantially identical to said block bodies, with the other block bodies and said runnable block being stackable so that an attaching surface of said upper engage section is adjacent to a lower engage section of one of the other block bodies, and an attaching surface of said lower engage section is adjacent to an upper engage section of another of the block bodies; and a plurality of wheels rotatably attached to both sides of said block body, whereby a part of each of said wheels protrudes farther downward than a lowermost surface of said block body, and a diameter of each wheel is set approximately equal to a distance from the attaching surface of said upper engage section to the attaching surface of said lower engage section.

16. The runnable block according to claim 15, wherein each of said wheels has a wheel surface having a wheel engage portion for permitting said wheels to be engaged with each other.

17. The runnable block according to claim 15, wherein said block body has a front face and a rear face, and a block coupling portion for permitting blocks to be coupled together provided on at least one of the front face and the rear face.

18. The runnable block according to claim 17, wherein each said wheel has a surface, and a wheel engage portion for permitting said wheels to be engaged with each other provided on the wheel surface.

19. The runnable block according to claim 15, wherein opposing wheels are coupled together using wheel shafts, and wherein a length of said block body in a forward and backward direction is approximately twice a distance between said wheel shafts, which is set approximately equal to a sum of a distance from a front wheel shaft to a front end of said block body, and a distance from a rear wheel shaft to a rear end of said block body.

20. The runnable block according to claim 15, wherein said engage sections are provided on substantially center portions of the top and bottom surfaces of said block body, respectively.

21. The runnable block according to claim 15, wherein the upper engage section is formed in one of a shape of a projection, a recess, and a combination of said projection and recess, and the lower engage section is formed in one of a shape of a recess, a projection, and a combination of said recess and projection, which is mateable with said one of said projection, recess, and combination of said projection and recess.

22. The runnable block according to claim 15, wherein said engage sections have first engage sections provided approximately at a center of the top and bottom surfaces of said block body.

23. The runnable block according to claim 22, wherein said engage sections further have lower second engage sections, provided on at least one of a front side and a rear side of said bottom surface of said block body with respect to said center of said bottom surface, and upper second engage sections provided on said top surface of said block body, said lower second engage sections being engageable with at least one of the upper first engage sections and the upper second engage sections of another runnable block, said upper second engage sections being engageable with at least one of the lower first engage sections and the lower second engage sections of another runnable block.

24. The runnable block according to claim 18, wherein said engage sections, said block coupling portions and said wheel engage portions are any one of an engage member, a fitting member, and a sucker.

25. The runnable block according to claim 15, wherein said block body is provided with a driving device for driving said wheels.

26. The runnable block according to claim 15, wherein when said runnable block and the other block bodies are coupled one on another, the wheels of any overlying block contact at least one of the wheels of an underlying block.

* * * * *